US007963865B2

(12) United States Patent
Rigoli

(10) Patent No.: US 7,963,865 B2
(45) Date of Patent: Jun. 21, 2011

(54) AUTOMATED TORSION DRIVEN SPORTS GOAL PRACTICE BACKSTOP

(76) Inventor: Michael Rigoli, Hopedale, MA (US)

( * ) Notice: Subject to any disclaimer, the term of this patent is extended or adjusted under 35 U.S.C. 154(b) by 80 days.

(21) Appl. No.: 12/070,129

(22) Filed: Feb. 19, 2008

(65) Prior Publication Data

US 2009/0209372 A1 Aug. 20, 2009

(51) Int. Cl.
*A63B 71/00* (2006.01)

(52) U.S. Cl. ..... 473/478

(58) Field of Classification Search ..... 473/478, 473/404, 410, 415, 476, 435; 160/45, 53
See application file for complete search history.

(56) References Cited

U.S. PATENT DOCUMENTS

| | | | | |
|---|---|---|---|---|
| 5,195,551 | A * | 3/1993 | Ju | 135/126 |
| 6,746,348 | B2 * | 6/2004 | Barnes et al. | 473/433 |
| 6,800,043 | B1 * | 10/2004 | Pohrer | 473/493 |
| 2009/0069124 | A1 * | 3/2009 | Forlini et al. | 473/435 |

* cited by examiner

*Primary Examiner* — Gene Kim
*Assistant Examiner* — Amir Klayman
(74) *Attorney, Agent, or Firm* — Bay State IP; Adam J. Bruno

(57) ABSTRACT

An automated torsion driven sports goal practice backstop which appends to any size of sports goal and may remain in place, if desired, at the conclusion of practice and during games. The sports goal practice backstop utilizes a torsioning system and flexible net mechanism in order to provide for easy installation and subsequent tension thereof. During practice, the sports goal backstop of the present invention provides a suitable backstop to stop most balls from traveling beyond the goal. At the conclusion of practice, the sports goal backstop of the present invention is mechanically foldable via automation of rotating handles and thus, the instant system need not be removed at the conclusion of practice. Rather, the sports goal backstop of the present invention may remain in position, out of sight, in its folded configuration during a game without interfering with normal play.

13 Claims, 26 Drawing Sheets

RD
RD
RD
20
24
24
30
33
70

AUTOMATED TORSION DRIVEN SPORTS GOAL PRACTICE BACKSTOP

FIELD OF THE INVENTION

The present invention relates generally to sporting goods, namely sports goal practice backstops for sports such as, but not limited to, lacrosse, soccer, filed hockey and hockey, including improvements to said sports goals including automated torsion driven folding mechanisms.

BACKGROUND OF INVENTION

A sports goal backstop is often utilized during practice sessions to aid in retaining the ball or playing object within the confines of the playing field and also in retrieval of shots that miss the desired mark. The instant backstop id design to facilitate in the prevention of an errant shot from traveling beyond the goal and thus eliminates the need for the players to give chase, taking time away from the practice session. Further, the sports goal backstop prevents the loss of a ball due to an errant shot. The sports goal backstop keeps the ball in the general vicinity of the practice session. In particular, the instant backstop may be useful during practices sessions for sports such as lacrosse and soccer.

Commencing at the youth level and carrying far beyond to the polished skills of professional athletes in such sports as lacrosse, hockey and soccer, players are coached to shoot for the corners and side gaps of the goal as openings exist therein and also as the goalie is less capable of protecting these areas. Therefore, honing such skills affords the player the highest probability of scoring a goal. In some sports, lacrosse in particular, players are also coached to take what's known as "bounce shots." This tactic occurs when a player shoots the ball to a spot in the crease area, in front of the goal and the ball bounces from the ground into the upper part of the goal. Due to the blind nature of the shot, when taken in conjunction with the level of timing required by a goaltender to defend such shot, defense is normally rendered nearly impossible when placement is correct.

The selection of shots discussed above, while vexing to a goaltender in theory, rarely find the proper location in practice and thus, during training when the player actually attempts to execute such intricate shots, the object utilized, be it ball, puck, etc., rarely hits the intended target or spot, due mainly to the lack of skill and accuracy required. Thus, depending on the location of the field or rink, and the inherent proximity to wooded areas, houses and/or automobiles, when shots are missed, the ball may be lost and damage may additionally be incurred by surrounding houses, automobiles and even people or animals.

Ergo, as for example lacrosse balls can cost as much as $2.00, such a level loss on a regular basis may render practicing such intricate shots prohibitive from a budgetary stand point, thus impeding creative playmaking activity. Furthermore, as innocent bystanders or personal property may withstand injury or damage, taking chances will inherently be discouraged and as such, the creativity of the players may be stifled.

Moreover, possibly the most poignant result involves the loss of valuable practice time and efficiency incurred in retrieving these wayward balls. And obviously such a disjunctive, interrupted practice situation can become frustrating, discouraging and cause players, especially younger players, to quickly loose interest and/or practice his or her shooting drills less.

Existing backstop designs in the current state of the art today require extensive set up and maintenance. Currently utilized is a "fence" like design that is simply a long metal tubular framed net that installs to the ground and is held up by flimsy foot-like base members and stabilizing cables at each end. This type of design is normal constructed behind the goal and is likely permanently secured due to the difficulty in set up and handling. Thus, this "fence" type design offers no backstop support for "bounce shots" as described above.

Another design within the current state of the art comprises a "cage" type design, similar to a golf practice apparatus. This invention is designed to fully encase the entire goal, but possesses very limited backstop protection from side to side and above the goal standpoints. Additionally, the cage-like design is extremely restrictive when trying to practice shooting on net at an angle.

One common factor evident in all of the above-discussed designs is a tendency toward apparatuses, which are esthetically unpleasing when located in a user's yard or on a sports field. Further exacerbating that aesthetics problem, many of these systems can not easily be stored away at the end of practice and thus must then be left around, which renders these designs an eyesore and also creates the opportunity for the systems to be damaged or stolen.

In many prior designs, a sports goal backstop involves a backstop, which is statically attached to a practice goal, which is used in lieu of the goal. In such a formation, the sports goal backstop/practice goal unit must be transported to the field, set up for practice, and then transported from the field. This procedure is not only cumbersome but time consuming as well.

In other instances, the sports goal backstop is a removable backstop that can be used along with the goal. In this instance, the sports goal backstop must still be transported to the field, set up for practice, and then transported from the field. As a result, this procedure is cumbersome and time consuming as well. Illustrated in U.S. Patent Publication No. 2007-0158913-A1 to Rigoli, non-automated sports goal backstops designed to support practice sessions yet need not be removed from the field in order to ready the field for game play, but can be easily removed if needed.

What is needed is a design of sports goal practice backstop which attaches to a goal and which does not have to be removed at the conclusion of practice, but which may be unobtrusively folded out of sight without interfering with the goal.

Moreover, what is needed is a system which comprises a sports goal apparatus and practice apparatus yielding a unitary configuration, wherein the practice apparatus incorporates fully retractable capabilities. Further, what is needed is an automated system which is also easily and quickly dissembled in the case of needed removal from the play. Finally, what is need is an automated system which can be transported to and from the practice field in a container which a sole individual can transport.

SUMMARY OF THE INVENTION

The instant invention, as illustrated herein, is clearly not anticipated, rendered obvious, or even present in any of the prior art mechanisms, either alone or in any combination thereof. An automated torsion driven sports goal practice backstop, designed to compensate for the aforementioned drawbacks and limitations would afford significant improvement to numerous useful applications. Thus the several embodiments of the instant invention are illustrated herein.

The present invention reveals the next generation in sports goal practice backstops. Unlike prior practice backstops, the instant invention discloses an automated design featuring retractable actuation handles which can be fully integrated to the profile of an existing goal, thus allowing the backstop to remain in place during game time if desired.

In the present invention, the sports goal backstop attaches to any goal and may remain in place, if desired, at the conclusion of practice and during games. During practice, the sports goal backstop of the present invention provides a suitable backstop to stop most balls from traveling beyond the goal. Further, as the instant backstop also features easy attachment and removal, the system may be readily broken down and removed for game time if desired. At the conclusion of practice, the sports goal backstop of the present invention is foldable such that it need not be removed at the conclusion of practice. Significantly, the sports goal backstop of the present invention may remain in position, out of sight, in its folded configuration during a game with minimal to no interference with normal play.

Unlike the existing designs on the market today which are large, unsightly and cumbersome to employ and maintain, the instant innovative Rigoli Design™ or RD™ backstop design is an integral part of the goal itself. The system weighs very little, fits goals of all pipe diameters and goal widths, is easy to set up and install and fits with a 64 inch×17 inch×7 inch box or in a travel bag or other duffle bag mechanism. Additionally, the instant system provides coverage only around the area of the goal that is functional, the front face of the entire goal and also allows the player to stow the RD™ backstop netting behind the goal in a non-functional area so that the goal can be practiced on without the interference of a backstop. The benefit of this design is that the player can easily deploy the back stop for practice and then quickly stow it away for game like shooting and scrimmages.

After the RD™ backstop system has been installed it requires only one person to deploy and stow the system. The system operates from either side of the goal and is a simple cam operated lever that is assisted by torsion springs for balance and ease of operation. The operator simply pulls one of the two handles to release it from the stored position, rotates it to engage the cam and lifts the backstop into position, the operator then pushes the handle back into the stored position, pulls the side nets to deploy the outer net poles and the RD™ backstop is ready to use. Repeat this procedure in reverse to stow away the backstop. The backstop remains stable during deployment due to the counterbalance weight system installed on the rear section of the goal.

The RD™ backstop design offers shot protection from all angles including the top due to its innovative forward angular design on all three sides. The coverage area is extremely generous on all three sides as well. The top angle design allows the player to take bounce shots with a high probability of stopping it in the event that it misses the intended target. The corner and side gap shorts are supported by the forward angular side design. If the player wishes to practice sharp angle shots from either side, the player simply folds the shooting side back onto the goal, leaving the rest of the apparatus in tact and functioning, thus allowing the player to shoot without interference from the backstop on that given side.

It is a salient objective of the present invention to provide a sports goal backstop to support practice sessions, which can be installed and removed with ease and yet operated via of an automated system. It is a further object of the present invention to provide a sports goal practice backstop that need not be removed from the field in order to ready the field for game play; however, the sports goal practice backstop can be easily removed if needed.

It is a further objective of the present invention to provide a sports goal practice backstop that securely attaches to a goal and is foldable such that it is out of sight and does not obstruct normal play. It is an even further object of the instant invention to provide an automated system which can be transported to and from the practice field in a single container and which can be transported by a sole individual.

It is a further objective of the instant invention to provide a practice net system that can be cleanly and quickly removed from a standard net apparatus, by utilizing slidably attached blocks which anchor the system and are joined by a common shaft which employs quick disconnect mechanisms as opposing sides.

Finally, it is an object of the present invention to provide an automated sports goal practice backstop that securely attaches to a goal and is foldable such that it is out of sight and does not obstruct normal play.

Accordingly, an improved automated torsion driven sports goal practice backstop and accompanying enhancements its component elements are herein described, which achieve these objectives, plus other advantages and enhancements. These improvements to the art will be apparent from the following description of the invention when considered in conjunction with the accompanying drawings wherein there has thus been outlined, rather broadly, the more important features of the automated torsion driven sports goal practice backstop in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

DETAILED DESCRIPTION OF THE INVENTION

Figure 1:
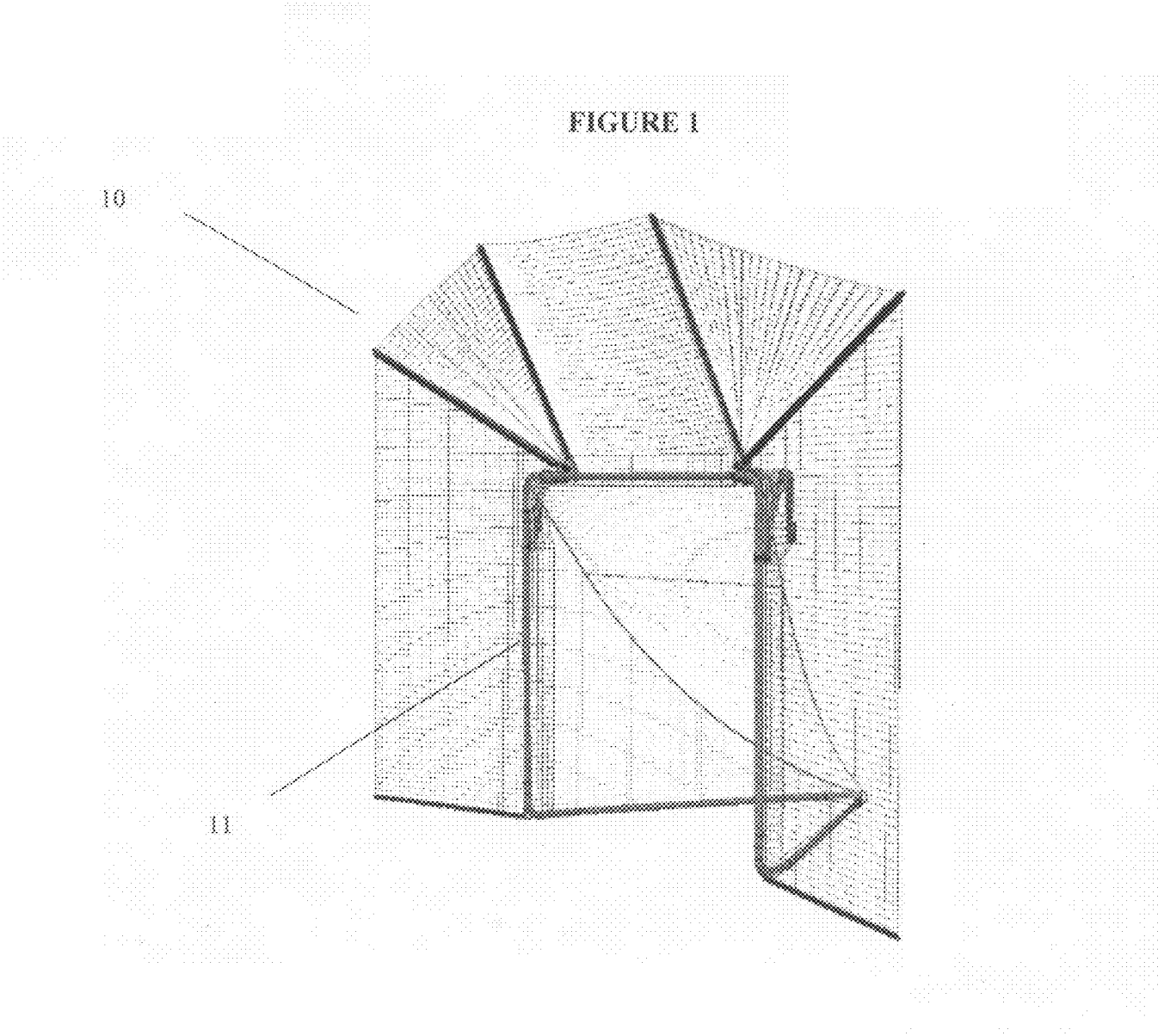
FIG. 1 is an isometric front view of the automated torsion driven sports goal practice backstop of the instant invention, attached to an existing goal and fully raised and torsioned.
Figure 2:
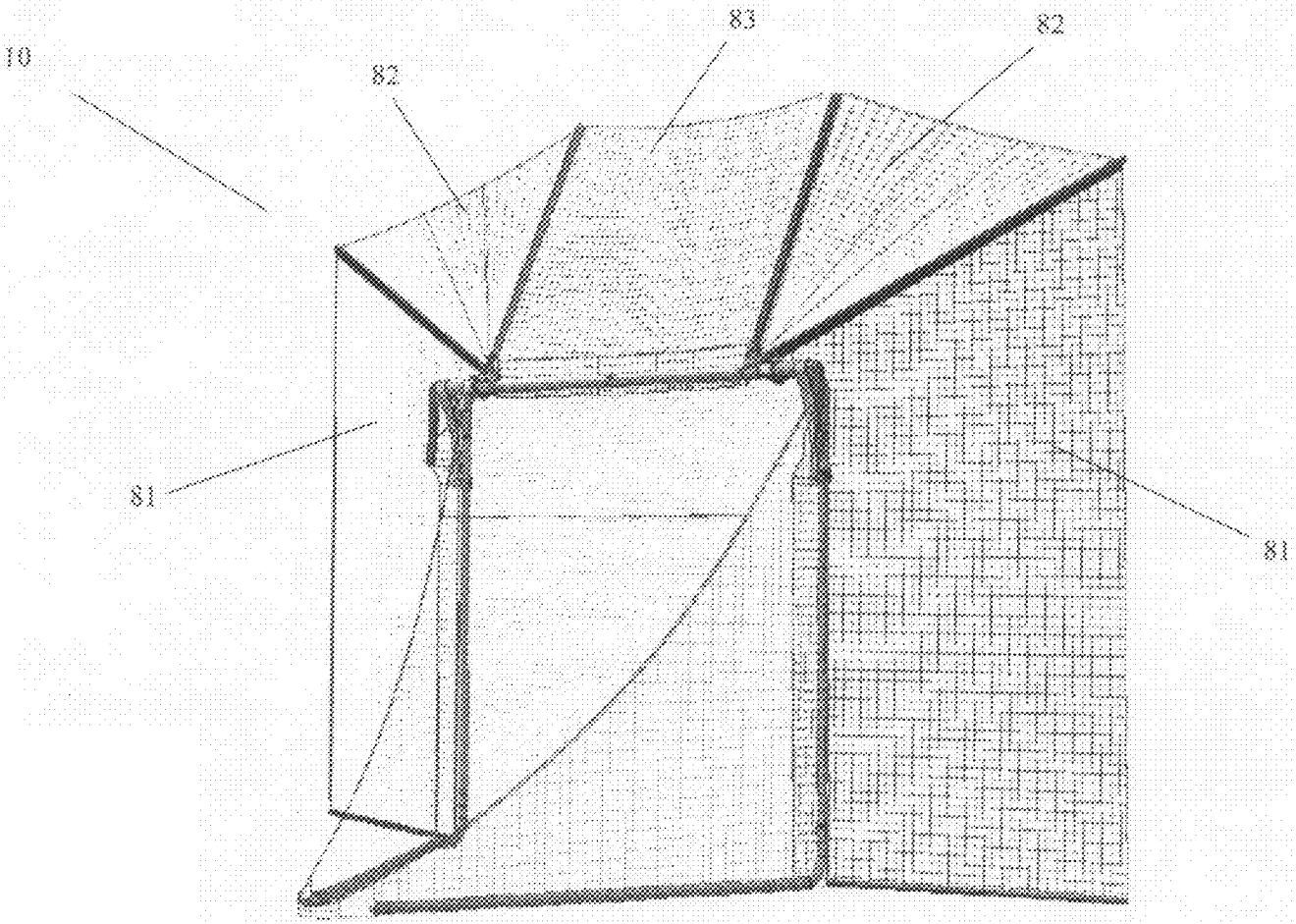
FIG. 2 is an isometric rear view of the automated torsion driven sports goal practice backstop of the instant invention, attached to an existing goal and fully raised and torsioned.
Figure 3:
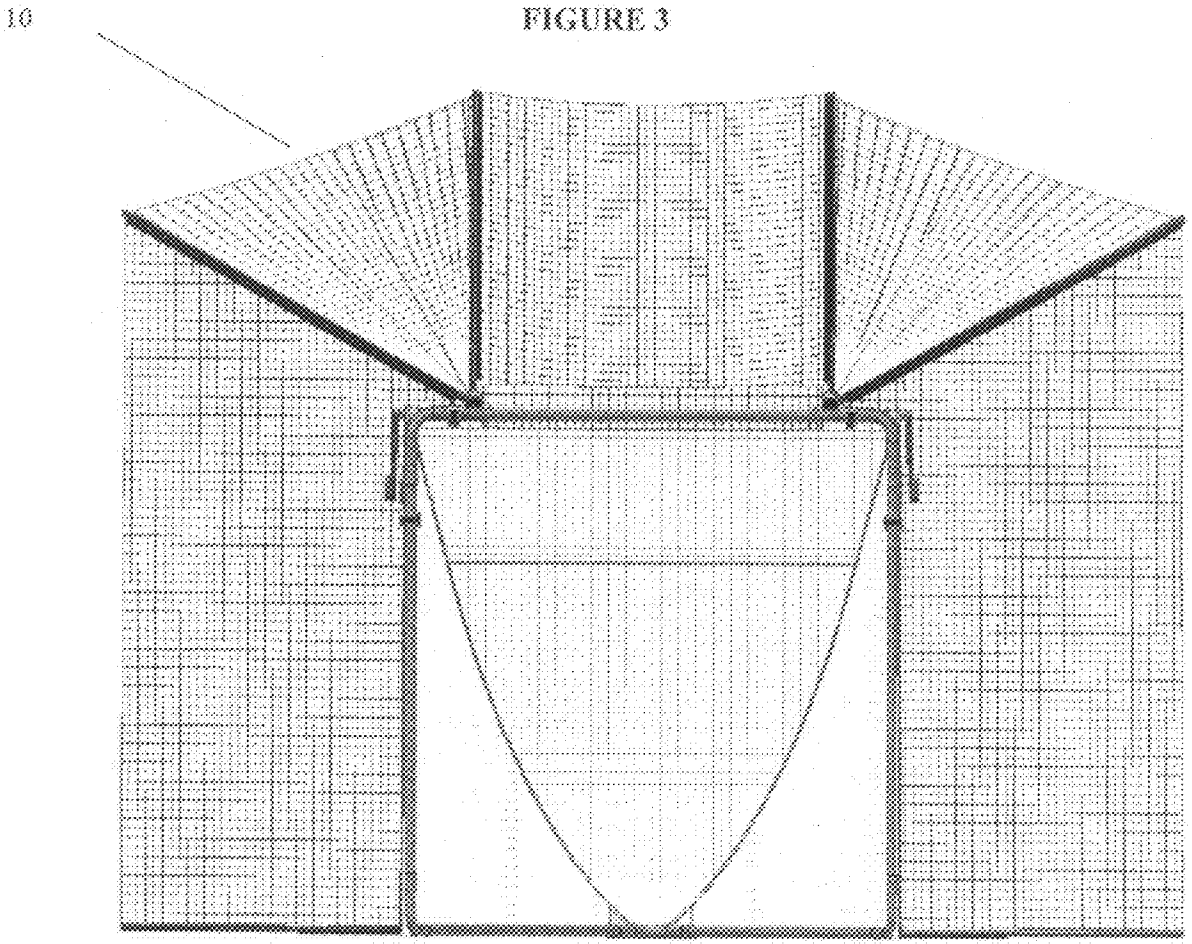
FIG. 3 is a front view of the automated torsion driven sports goal practice backstop of the instant invention, attached to an existing goal and fully raised and torsioned.
Figure 4:
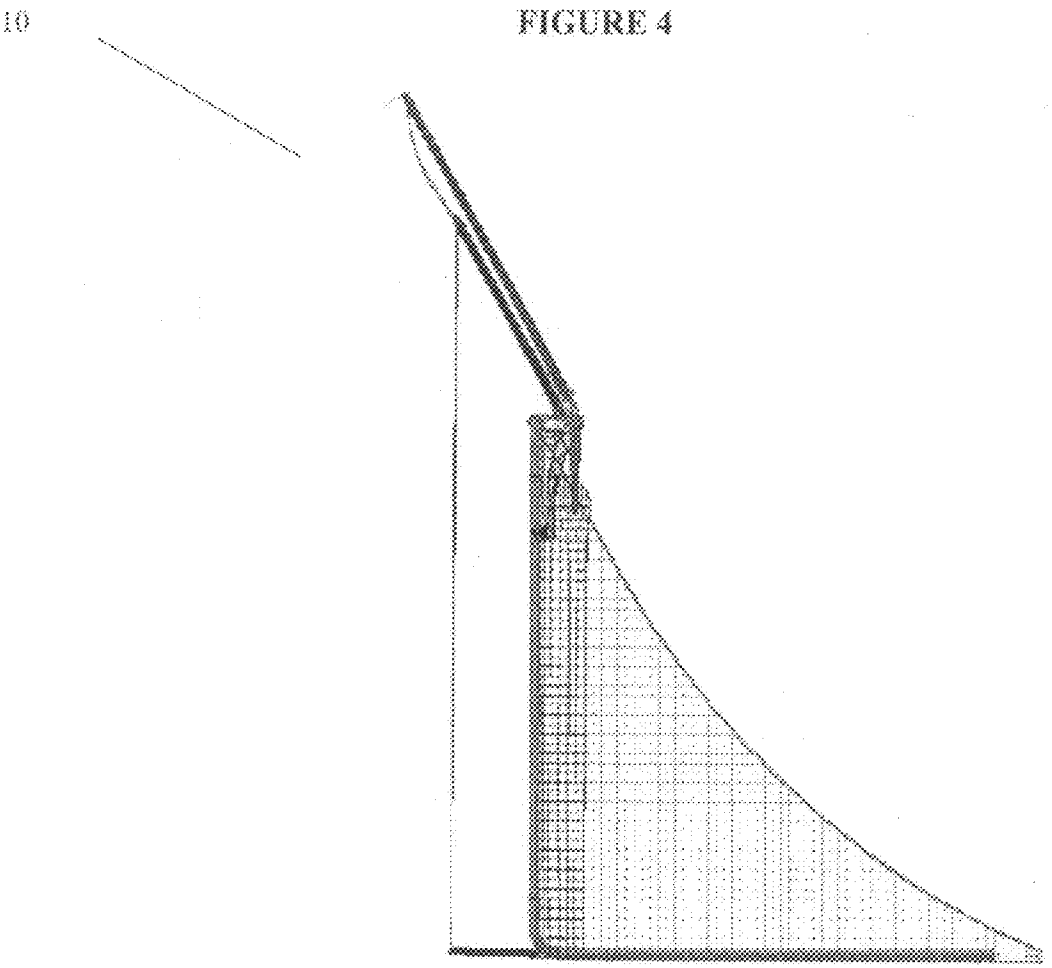
FIG. 4 is a right side view of the automated torsion driven sports goal practice backstop of the instant invention, attached to an existing goal and fully raised and torsioned.
Figure 5:
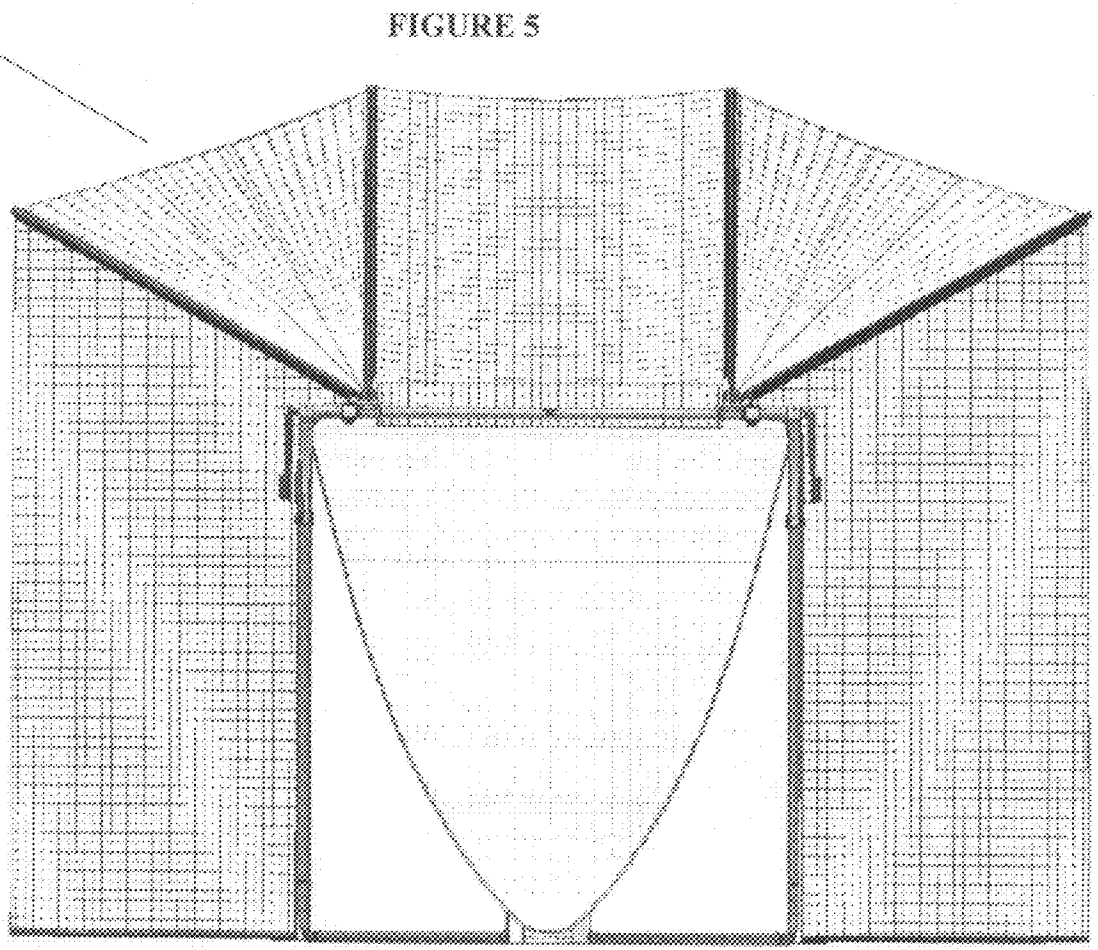
FIG. 5 is a rear view of the automated torsion driven sports goal practice backstop of the instant invention, attached to an existing goal and fully raised and torsioned.
Figure 6:
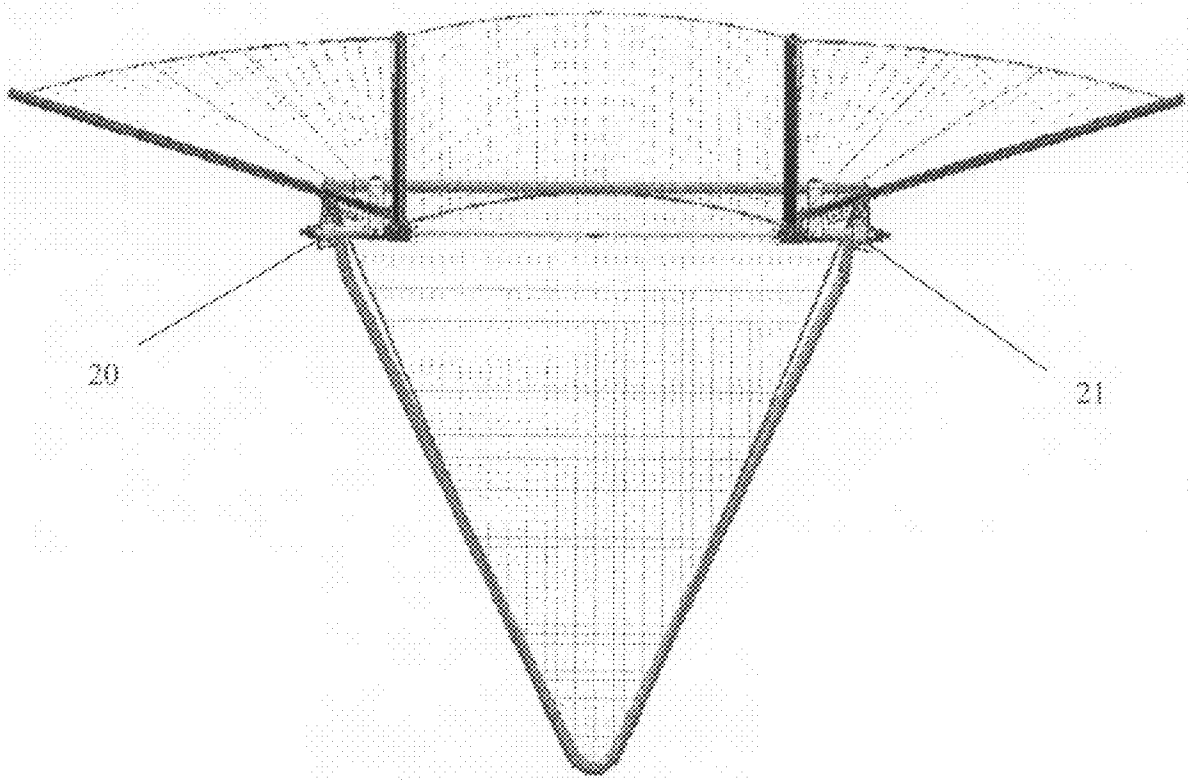
FIG. 6 is a top plan view of the automated torsion driven sports goal practice backstop of the instant invention, attached to an existing goal and fully raised and torsioned.

The detailed description set forth below in connection with the appended drawings is intended as a description of presently-preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as flywheel systems with magnetic bearings used in a variety of applications.

Referring now to the figures to better illustrate the present invention, in FIGS. 1-6, there is shown one embodiment of a sports goal practice backstop 10, as configured to attach to a lacrosse goal. FIGS. 1-20 illustrate the sports goal practice backstop 10 in a preferred embodiment as attached to a lacrosse net. In one embodiment, the invention may comprise a sports goal practice backstop 10 for removable attachment to a sports goal 11 and further comprising a right support structure 20 and a left support structure 21, wherein said right 20 and left support structures 21 are removably attached by a right 22 and a left attachment mechanism 23 to secure the respective support structures in place.

Figures 7A, 7B, 7C:
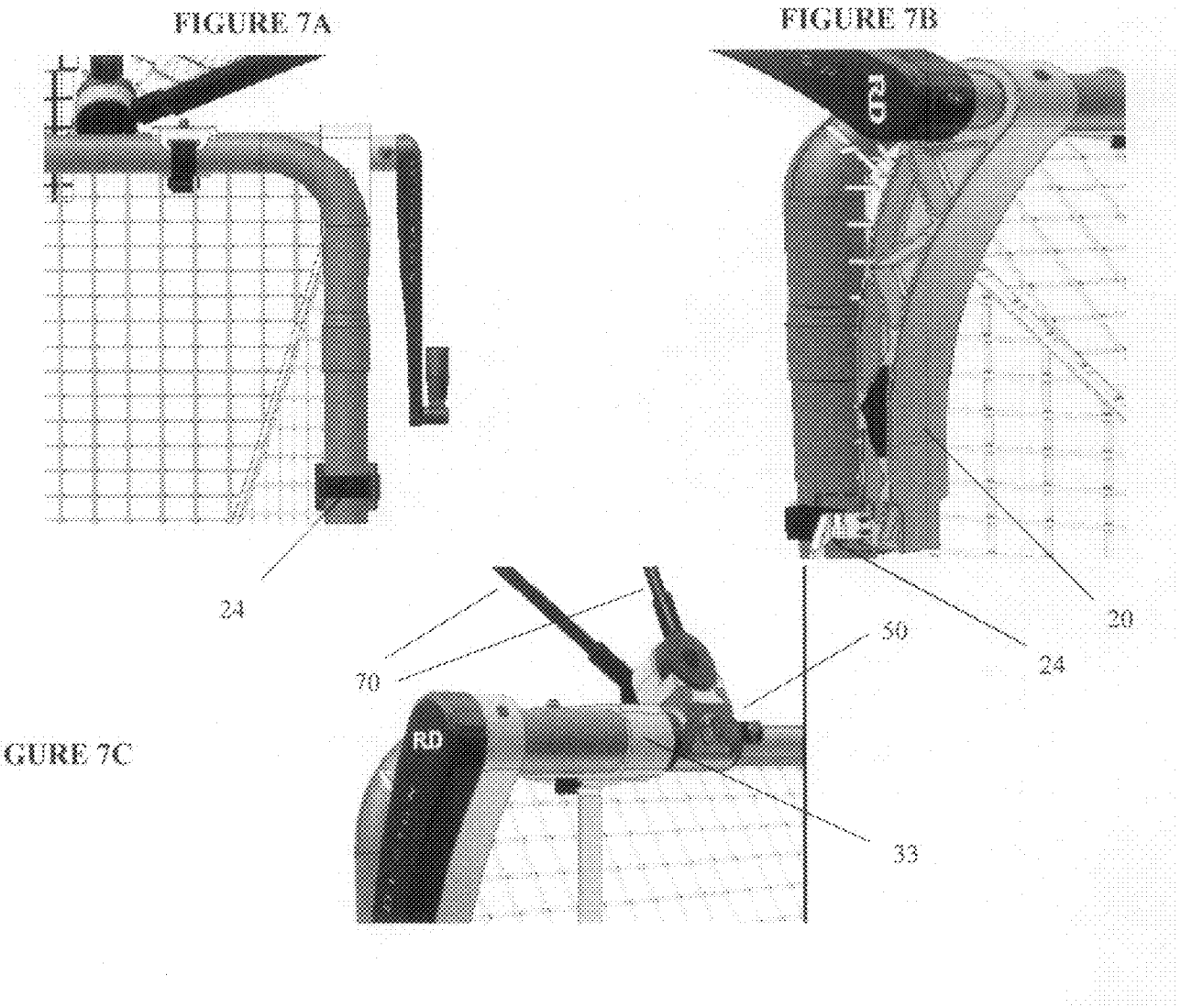
FIG. 7A is a front section view of the right support structure attached to the right side of an existing goal via the clip assembly with corresponding cinch strap.
FIG. 7B is a rear isometric section view of the right support structure attached to the right side of an existing goal via the clip assembly with corresponding cinch strap.
FIG. 7C is a rear isometric section view of the left pivot block in attached to the rear of an existing sports goal and in communication with the torsioning system, further illustrating communication with one of the plurality of support rods.
Figure 7D:
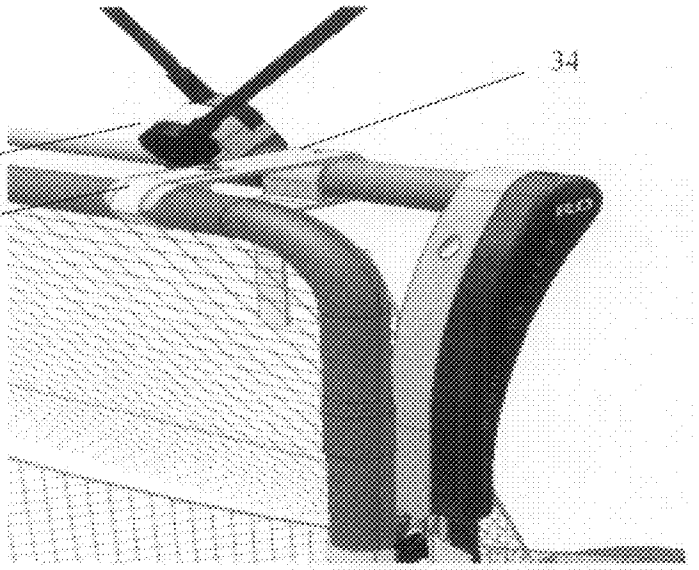
FIG. 7D is a front isometric section view of the left pivot block in attached to the rear of an existing sports goal and in communication with the torsioning system, further illustrating the pivot block and hanger assemblies.
Figure 7E:
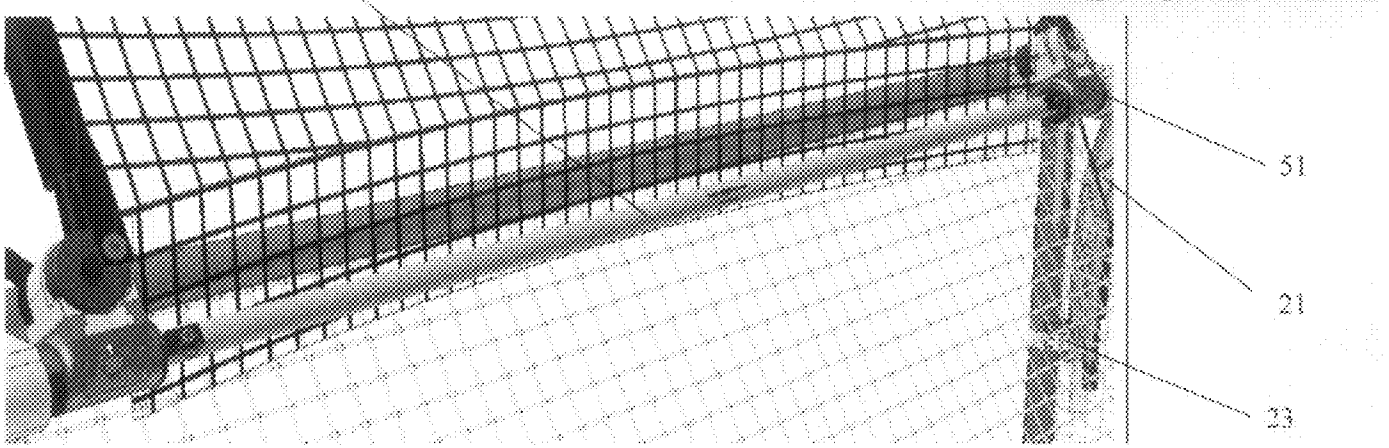
FIG. 7E is a rear isometric section view of the left pivot block in attached to the rear of an existing sports goal and in communication with the torsioning system, further illustrating the intermediate torque shaft spacer.
Figure 8A:
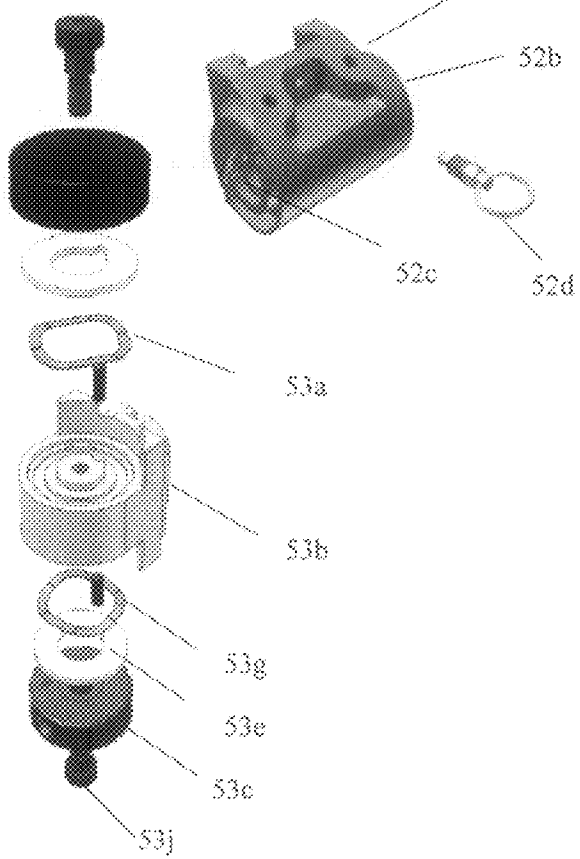
FIG. 8A is a explode view of the assembly of a pivot block, detached from the system.
Figure 8B:
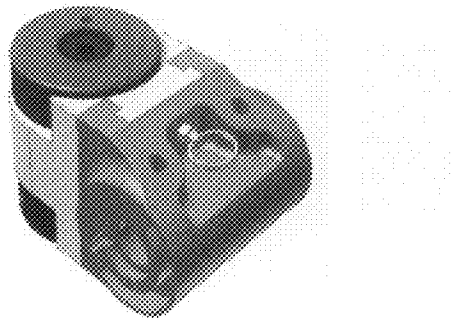
FIG. 8B is an isometric view drawing of a pivot block assembled fully assembled.
Figure 8C:
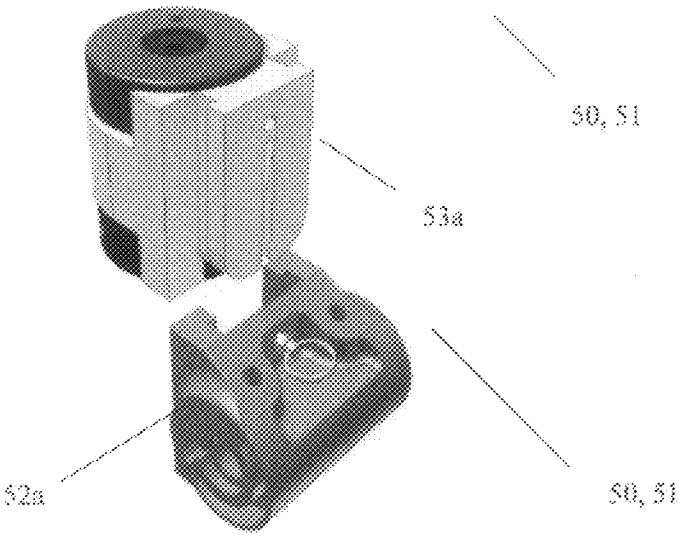
FIG. 8C illustrates a pivot block with the upper section slidably removed from the lower assembly.
Figure 9B:
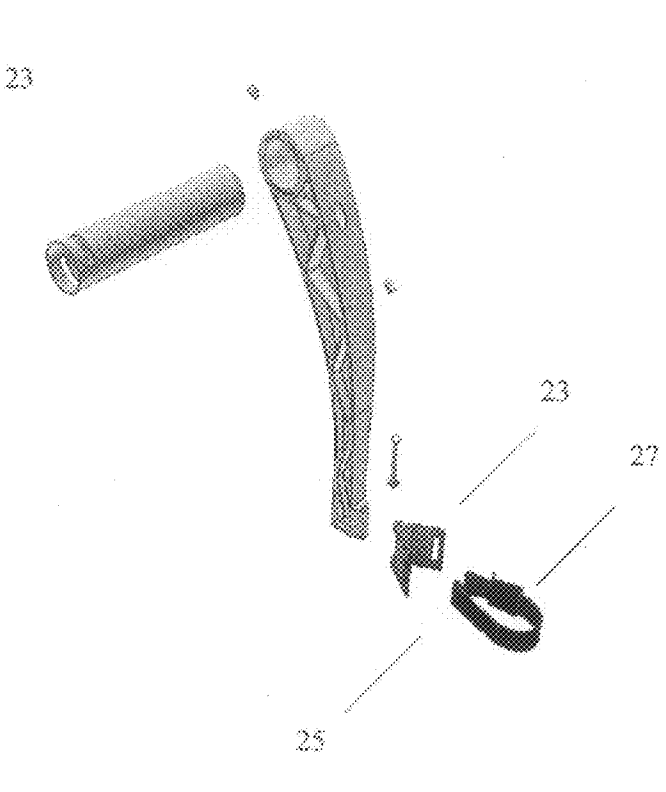
FIG. 9B is an exploded view of a support structure element, illustrating the internal elements including the clip assembly and the cinch strap.
Figure 9A:
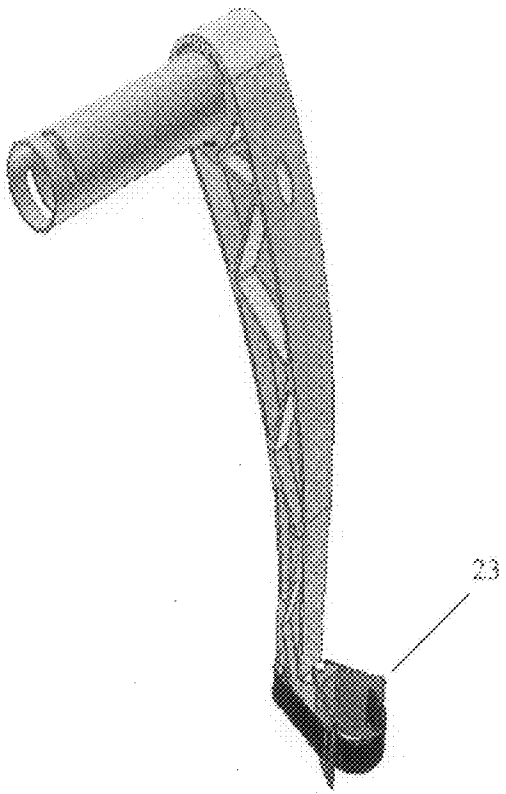
FIG. 9A is a isometric view of a support structure element, detached from the system.
Figure 10B:
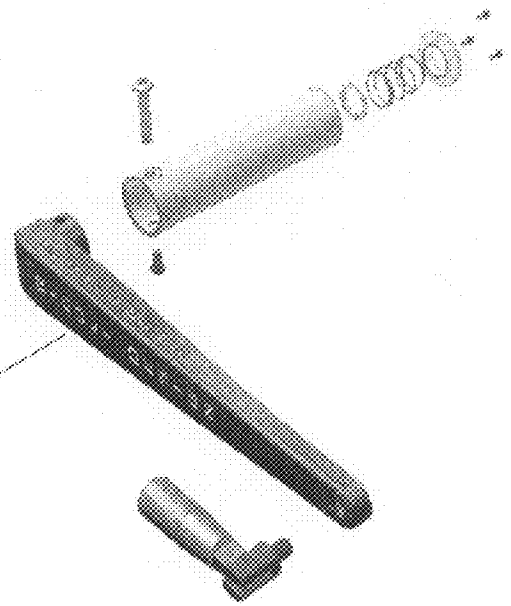
FIG. 10B is an exploded view of an actuation handle, illustrating the internal elements.
Figure 10A:
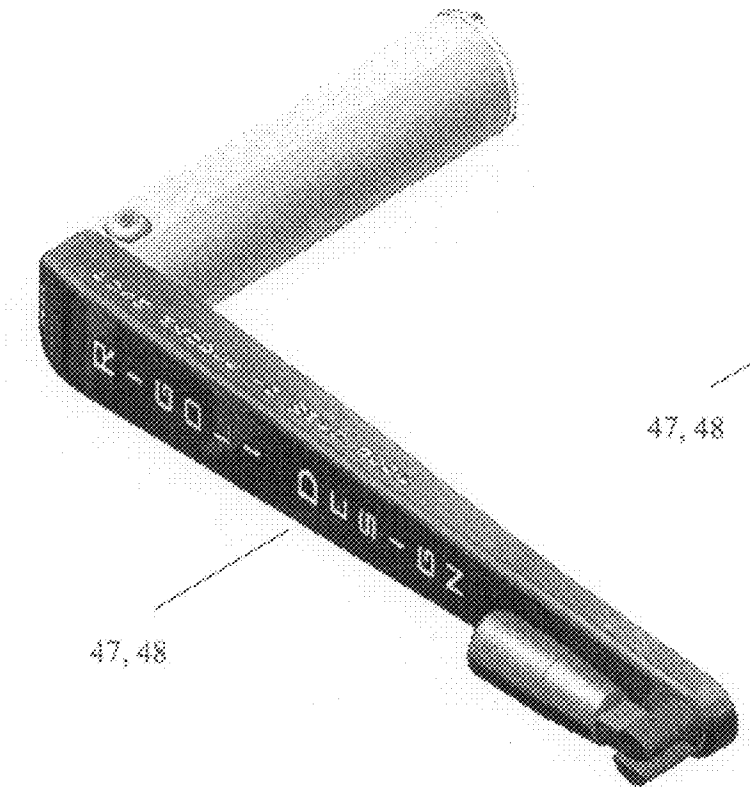
FIG. 10A is a isometric view of an actuation handle, detached from the system.
Figure 11B:
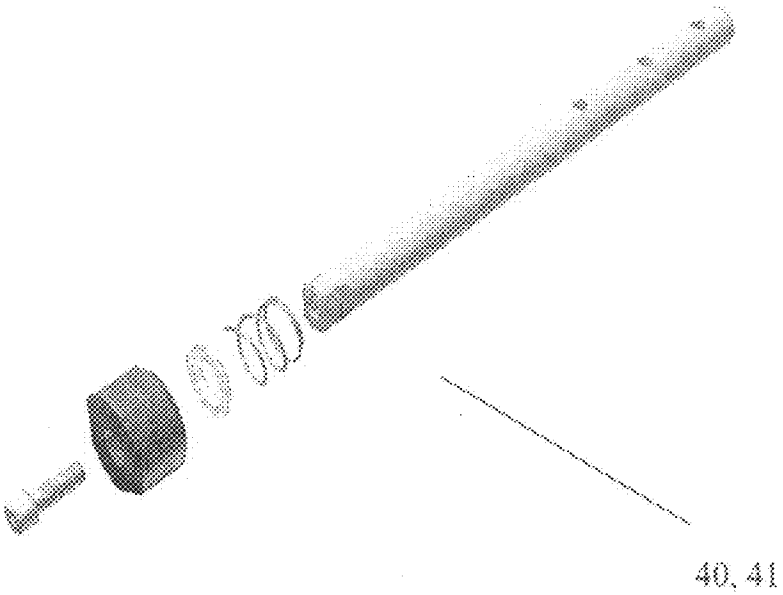
FIG. 11B is an exploded view of an actuation handle, illustrating the internal elements.
Figure 11A:
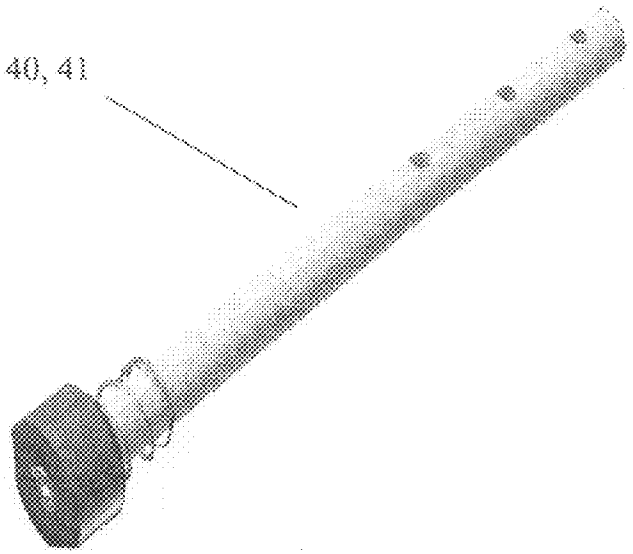
FIG. 11A is a isometric view of a torsioning assembly, detached from the system.
Figure 12B:
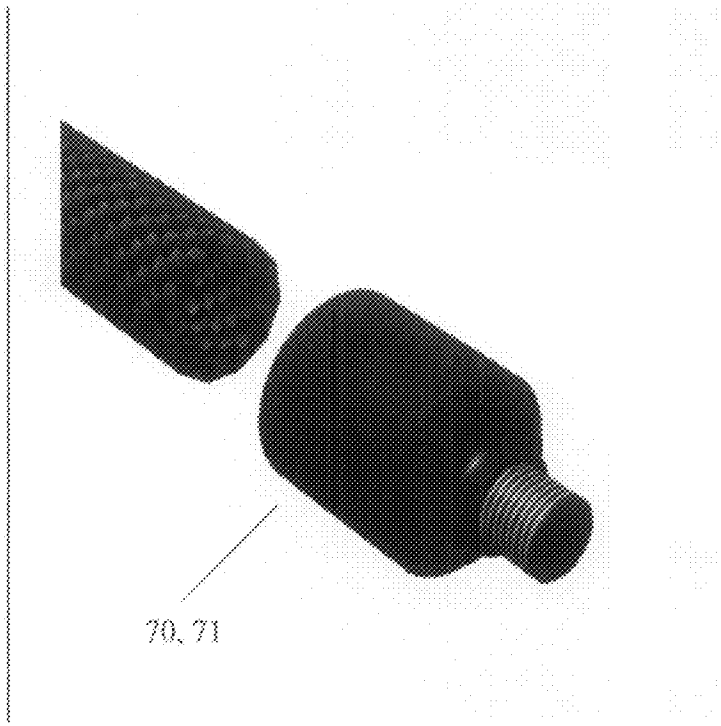
FIG. 12B is an exploded view of support rod assembly, illustrating the internal elements.
Figure 12A:
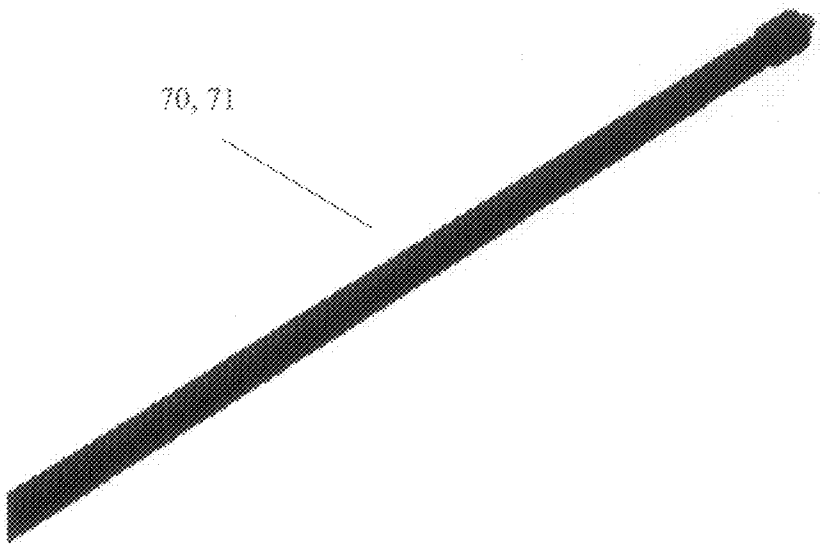
FIG. 12A is a isometric view of a support rod assembly, detached from the system.
Figure 13B:
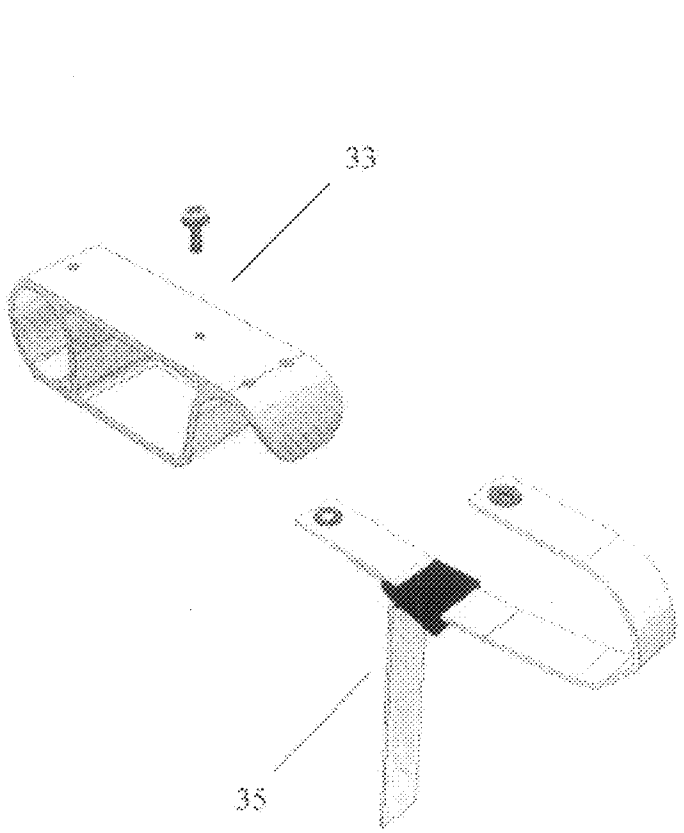
FIG. 13B is a isometric exploded view of an extruded aluminum hanger assembly with a cinch strap illustrated, detached from the system.
Figure 13A:
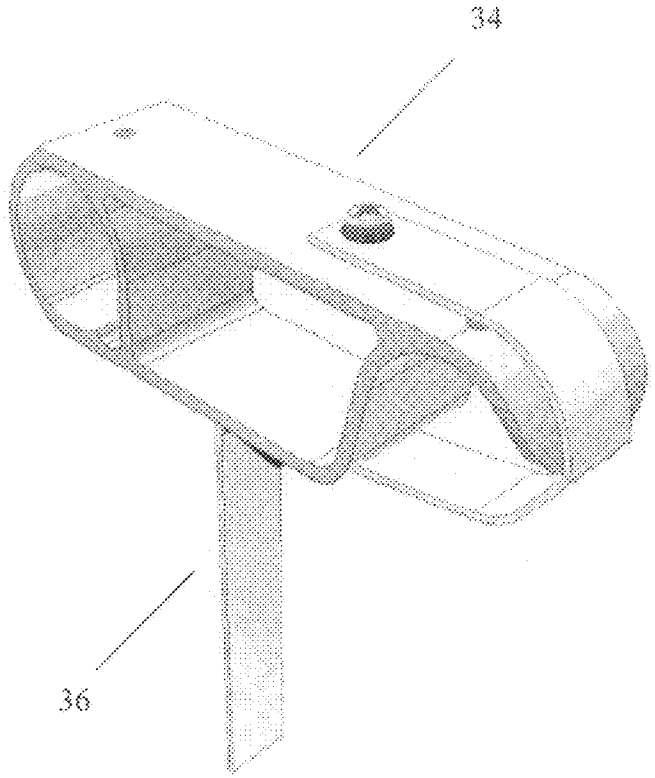
FIG. 13A is a isometric view of an extruded aluminum hanger assembly with a cinch strap illustrated, detached from the system.
Figure 14:
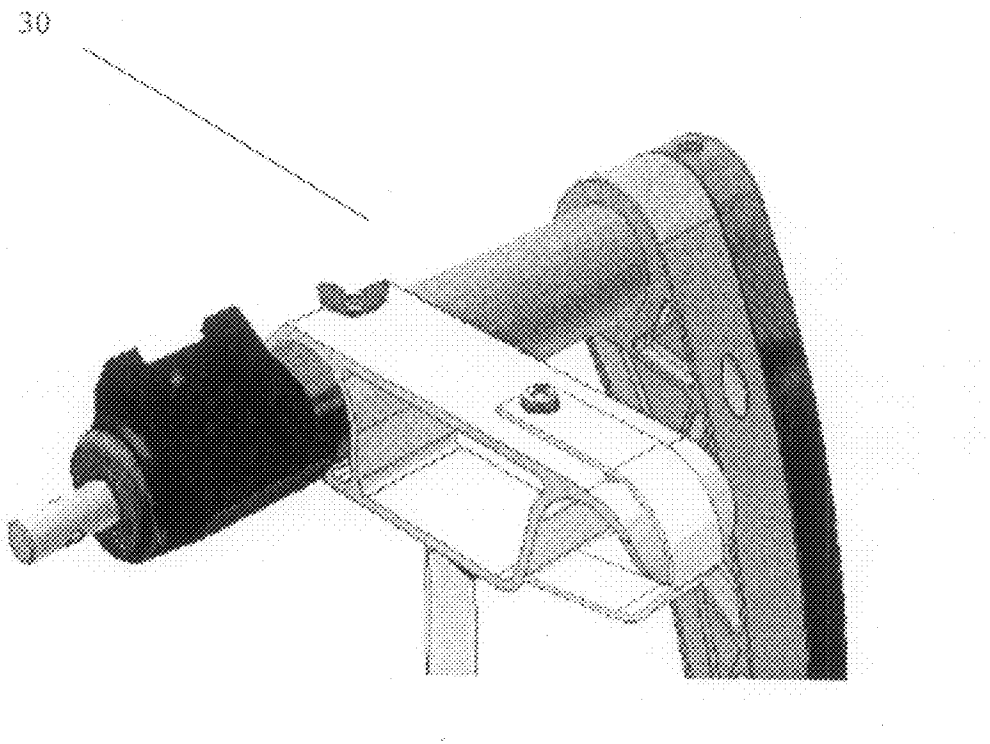
FIG. 14 is an isometric view of the overall torsion driven support rod activation system or overall hanger assembly.

FIGS. 7A-C illustrate that the right and left support structure attachment mechanism may further comprising a right 24 and left adjustable clip mechanism 25 and a right 26 and a left adjustable clip mechanism cinch strap 27. The invention may further disclose a torsion driven support rod activation system 30, or hanger assembly 30, comprising a right 31 and left actuation handle assembly 32 in transferred communication with said right 20 and left support structure 21. The torsion driven support rod activation system may comprise an attachment mechanism comprising a right 33 and left adjustable hanger retaining mechanism 34 including a first 35 and a second adjustable hanger cinch strap mechanism 36.

FIGS. 8A-13 further illustrate the numerous mechanisms involved with the overall torsion driven support rod activation system 30, or hanger assembly 30. Additionally illustrated, the right 31 and left actuation handle assembly 32 are in communication with a right 40 and left torque shaft assembly 41. The right 40 and left torque shaft assembly 41 are thus in transferred communication with the right and left actuation handle assembly and in transferred communication with said right and left support structure. Furthermore, the invention reveals a right 50 and left pivot block assembly 51, in communication with right 40 and left torque shaft assembly 41 and thus in transferred communication with said right 47 and left actuation handle assembly 48.

The left and right torsion driven support rod activation system 30 or overall hanger assembly 30 are joined by at least one torque shaft spacer or intermediate linking torque shaft mechanism 60. In a further embodiment, the left and right torsion driven support rod activation system 30 or overall hanger assembly 30 may be joined by two or more torque shaft spacer or intermediate linking torque shaft mechanisms 60 or even an adjustable type spacer in order to accommodate differing sizes of existing goals.

Also, disclosed is a removably attachable backstop net 80 and a plurality of right 70 and left 71 support or flexible pultrusion rods comprising a multi-positional, retractable construction, in communication with said right 50 and left pivot block assemblies 51 and possessing means for attachment of said removably attachable backstop net thereto. The pivot blocks may be disposed with female threads in order to mate with male threads provided to the support or pultrusion rods. Further the removably attachable backstop net may comprise a multiplicity of sections including the two outer sections 81, two midsections 82 and an inner section 83. The two midsections and said inner section are disposed in a non-perpendicular manner to an upper support of a goal. The two midsections and said inner section are disposed at an acute angle to said upper support of a goal at a thirty degree angle. The removably attachable backstop net may be attached to the flexible pultrusion rods by slipping the net over the respective rod and being secured by a strap attached to the net.

FIGS. 14A-B illustrate a counter balance bladder 91 comprising a fluid storage compartment. The sports goal practice backstop counter balance bladder 91 is removably attachable to the lower portion of an existing goal 11, mounting on the upper portions of rearward goal support 12. Additionally, an alternative counter balance bladder 92 embodiment, which includes a retaining platform is illustrated in FIGS. 16A-D. As seen, this alternative embodiment counter balance bladder 92 may be disposed at the rear portion of the existing net in order to keep the net from tipping forward. The bladder comprises a filling aperture, wherein the fluid required in order to counter-balance the existing net may be entered and may be disposed horizontally within the retaining platform. The bladder, and for that matter the retaining platform 93, may be comprised of a myriad of materials including but not limited to flexible and non-resilient polymers, composites and metals.

The left and right pivot blocks are in rotatable communication with the right and left torque shaft assembly and the right and left actuation handle assembly. Upon attachment of removably attachable backstop net to the plurality of support rods, rotation of actuation handle assemblies in a rearward direction that triggers the torsion application mechanism, wherein, the plurality of support rods are raised and backstop net is tensioned.

The sports goal practice backstop upon attachment of the removably attachable backstop net to the plurality of support rods and the rotation of the actuation handle assemblies in a forward direction triggers the torsion application mechanism and the plurality of support rods are lowered and the backstop net is detensioned. Further, in one embodiment, the right and left plurality of support or protrusion rods may comprise of two right and two left support or protrusion rods. The sports goal practice backstop further comprising a set of interchangeable shim mechanisms, in order to render the invention adaptable to any size of existing sports goal.

Figure 15A:
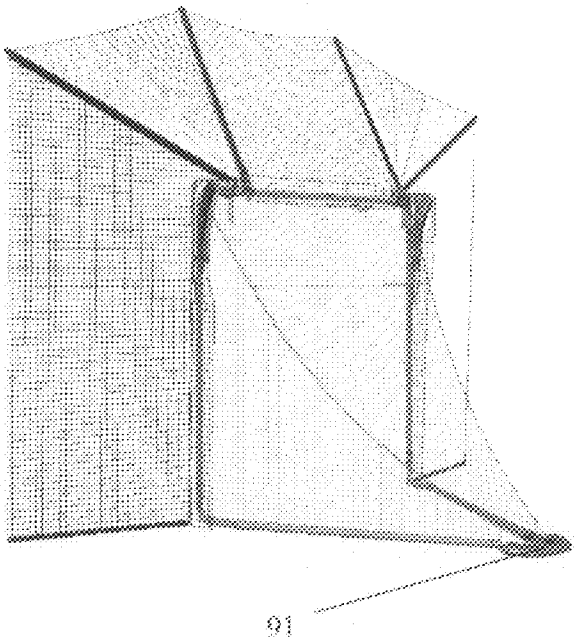
FIG. 15A is a rear isometric view of one embodiment of the counter balance bladder.
Figure 15B:
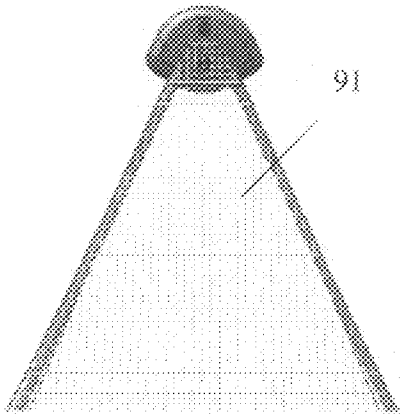
FIG. 15B is top isometric view of one embodiment of the counter balance bladder within the context of location on an existing goal.
Figure 15C:
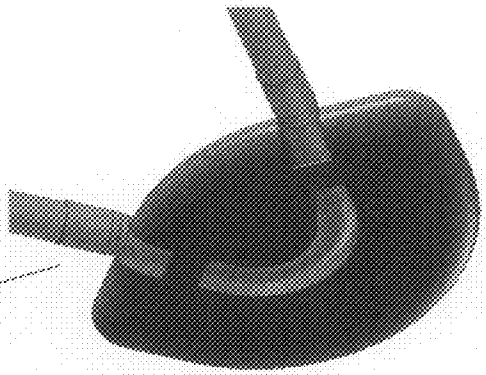
FIG. 15C is a bottom isometric view of one embodiment of the counter balance bladder.
Figure 16A:
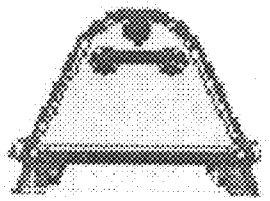
FIG. 16A is a top view of the counter balance bladder embodiment including retaining platform.
Figure 16B:
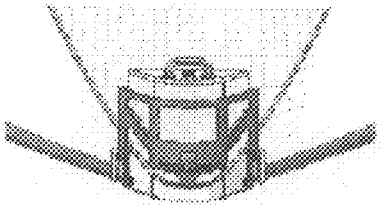
FIG. 16B is a rear view of the counter balance bladder embodiment including retaining platform.
Figure 16C:
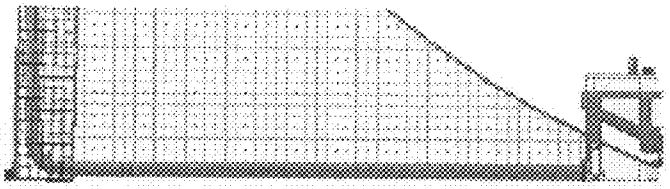
FIG. 16C is a side view of the counter balance bladder embodiment including retaining platform.
Figure 16D:
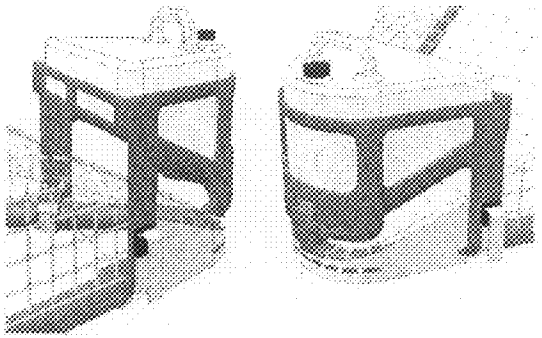
FIG. 16D is a pair of side isometric views of the counter balance bladder embodiment including retaining platform.

FIG. 15A illustrates a rear isometric view of one embodiment of the counter balance bladder. FIG. 15B illustrates a top isometric view of one embodiment of the counter balance bladder within the context of location on an existing goal. FIG. 15C illustrates a bottom isometric view of one embodiment of the counter balance bladder. FIG. 16A illustrates a top view of the counter balance bladder embodiment including retaining platform. FIG. 16B illustrates a rear view of the counter balance bladder embodiment including retaining platform. FIG. 16C illustrates a side view of the counter balance bladder embodiment including retaining platform. FIG. 16D illustrates a pair of side isometric views of the counter balance bladder embodiment including retaining platform.

In addition, the practice backstop right 40 and left torque shaft assemblies 41 may comprise, a shaft member 42, a retaining member 43, a washer member 44, a tensioning mechanism member 45, and, a fastening mechanism 46. The right and left tensioning mechanism 45 members may comprise a spring mechanism of metallic, composite or any other suitable material.

Moreover, the right 50 and left pivot block assemblies 51 may comprise, a shaft housing apparatus 52*a* comprising a first 52*b* and a second shaft receiving area 52*c* disposed to receive said torque shaft assembly and actuation handle assembly; a removably attachable locking pin mechanism 52*d*. The right 50 and left pivot block assemblies 51 may further comprise a support rod or pultrusion rod retaining housing 53*a* or sliding block 53*a* in sliding communication with said shaft housing apparatus 52*a*, disposed to receive and maneuver said plurality of support rods upon actuation of said shaft housing apparatus and further comprising an aperture 53*b* disposed to removably receive said removably attachable locking pin mechanism in communication with said shaft housing apparatus.

Further, the support rod or pultrusion rod retaining housing 53*a* may contain a static housing retaining mechanism 53*b*, a forward 53*c* and a rear rotatable support rod receiving hub 53*d*, a forward 53*e* and a rear washer member 53*f*, a forward 53*g* and a rear gasket member 53*h* and an aperture 53*i* disposed to removably receive said locking pin mechanism 52*d*. Additionally the retaining housing 53*a* may comprise a forward 53*j* and rear fastening mechanism 53*k*; and, wherein upon rotation of right and left actuation handle, said shaft housing apparatus transfers rotation to said forward 53*c* and rear rotatable support rod receiving hubs 53*d* in order to actuate said support rods.

In a further embodiment, the left hanger assembly comprising, a left spring loaded actuation lever, a pair of left net retainer rods, a left pivot block disposed to retain plurality of left net retainer rods wherein pivot block extends and retracts said net retainer rods relative to existing sports goal, a left torque shaft assembly, a left support structure, a left support hanger.

Further the right hanger assembly comprises, a right spring loaded actuation lever, a plurality of right net retainer rods, a right pivot block disposed to retain the plurality of right net retainer rods wherein the pivot block extends and retracts the net retainer rods relative to the existing sports goal, a right torque shaft assembly, a right support structure, a right support hanger, a removably attachable net mechanism in communication with the plurality of right and left net retainer rods, at least one torque shaft mechanism in communication with the right and left hanger assemblies wherein the application of a rotational force upon the right and left spring loaded actuation lever tensions the torque shaft mechanism, rotates the left and right pivot block, extends the plurality of left and right net retainer rods and tensions to the removably attachable net mechanism.

Figure 19A:
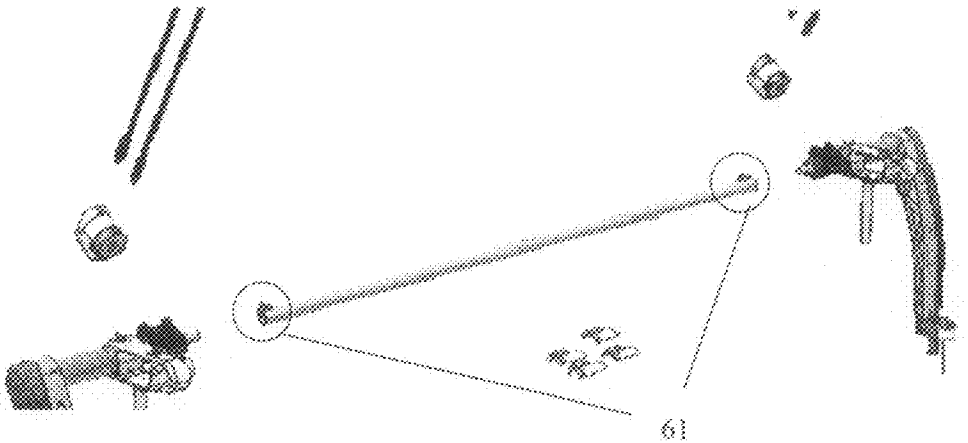
FIG. 19A is an isometric exploded view of one embodiment of intermediary shaft quick release mechanisms illustrated within the entire system.
Figure 24:
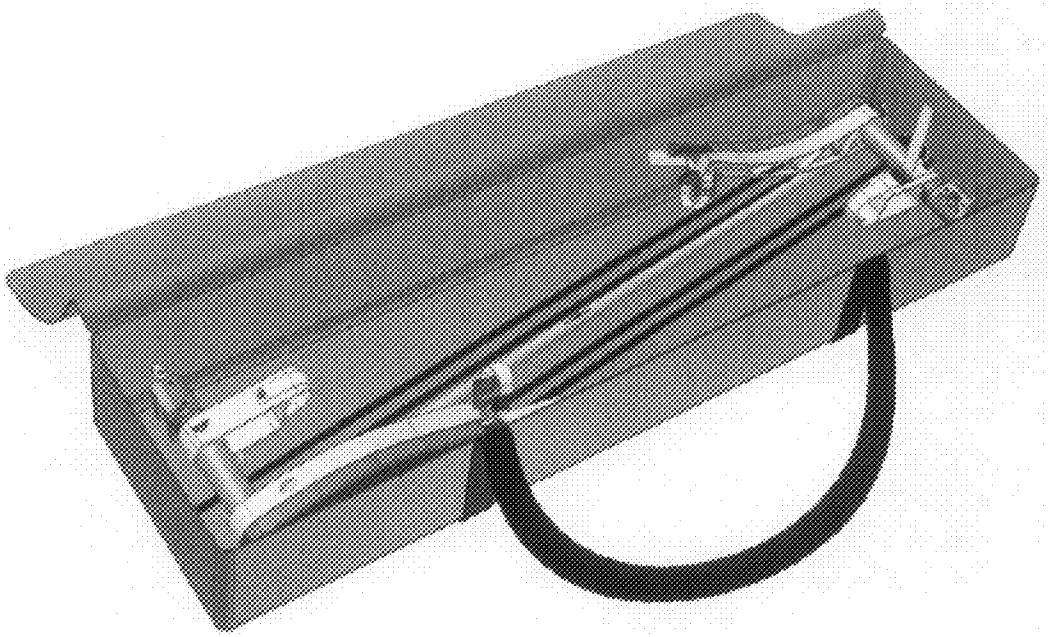

In one embodiment, the instant invention provides a practice net system that can be cleanly and quickly removed from a standard net apparatus, by utilizing two identical hangar assemblies comprising slidably attached blocks, which anchor the system and are joined by a common shaft. As illustrated in FIGS. 19A, B, this common shaft employs quick disconnect mechanisms 61, disposed at opposing sides. Thus, the entire apparatus, with nets still attached may be removed as a unit by way of removal of the sliding blocks. The entire apparatus may then be folded and stowed, with the nets attached, or unattached, in a duffel bag or box, as seen in FIG. 24.

These quick disconnect mechanisms 61 as installed within the intermediate linking torque shaft mechanism 60, may include such mechanisms as retractable locking pins, swage type mechanisms, sliding fitting or any other type of coupling mechanism know in the art. The respective hanger shafts will be fitted with the associated holes, swage receivers, sliding fittings, etc., in order to properly align with the shaft.

Further, the sliding pivot block assemblies 51 may thus be removed from the respective shaft housing apparatuses, the intermediate linking torque shaft mechanism 60 may be released via the quick disconnect mechanisms 61, and the entire system, with the netting still attached, can be folded and packed into a box quickly and efficiently for further use.

Figure 17:
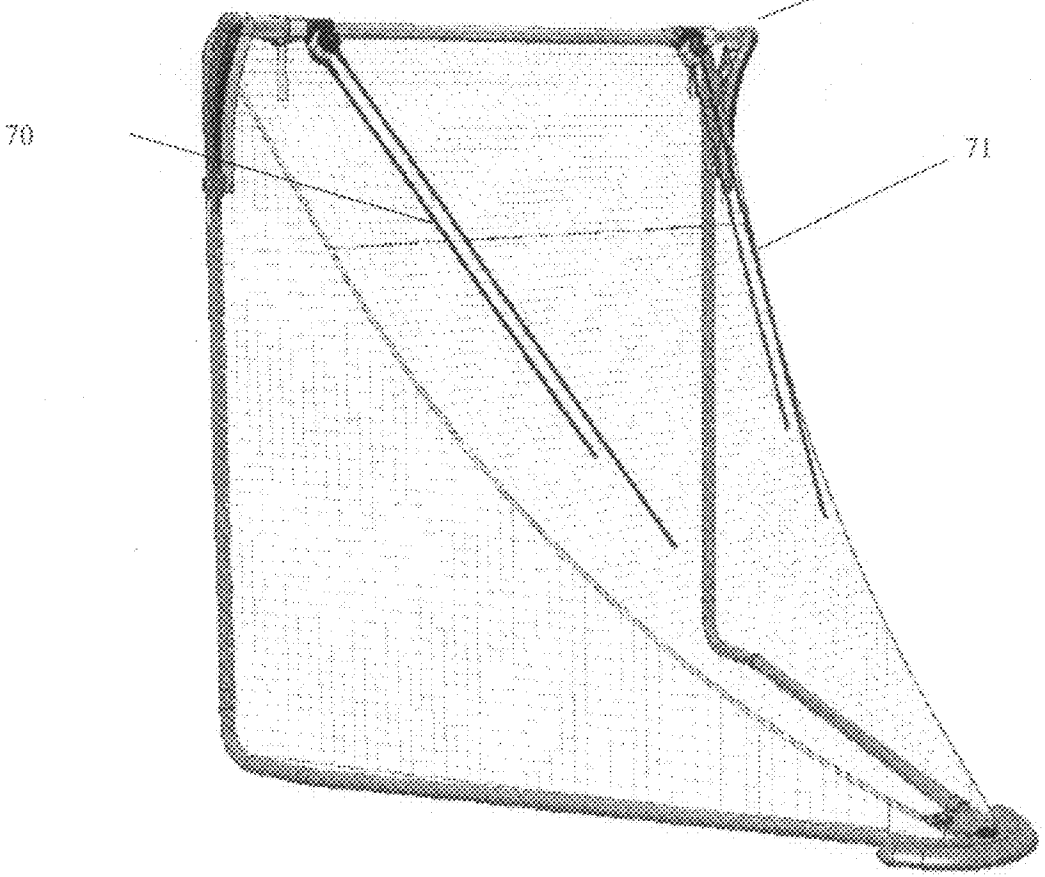
FIG. 17 is a rear isometric view of the entire system with the backstop net removed for clarity and the flexible pultrusion rods retracted and resting against the existing sports goal.
Figure 17A:
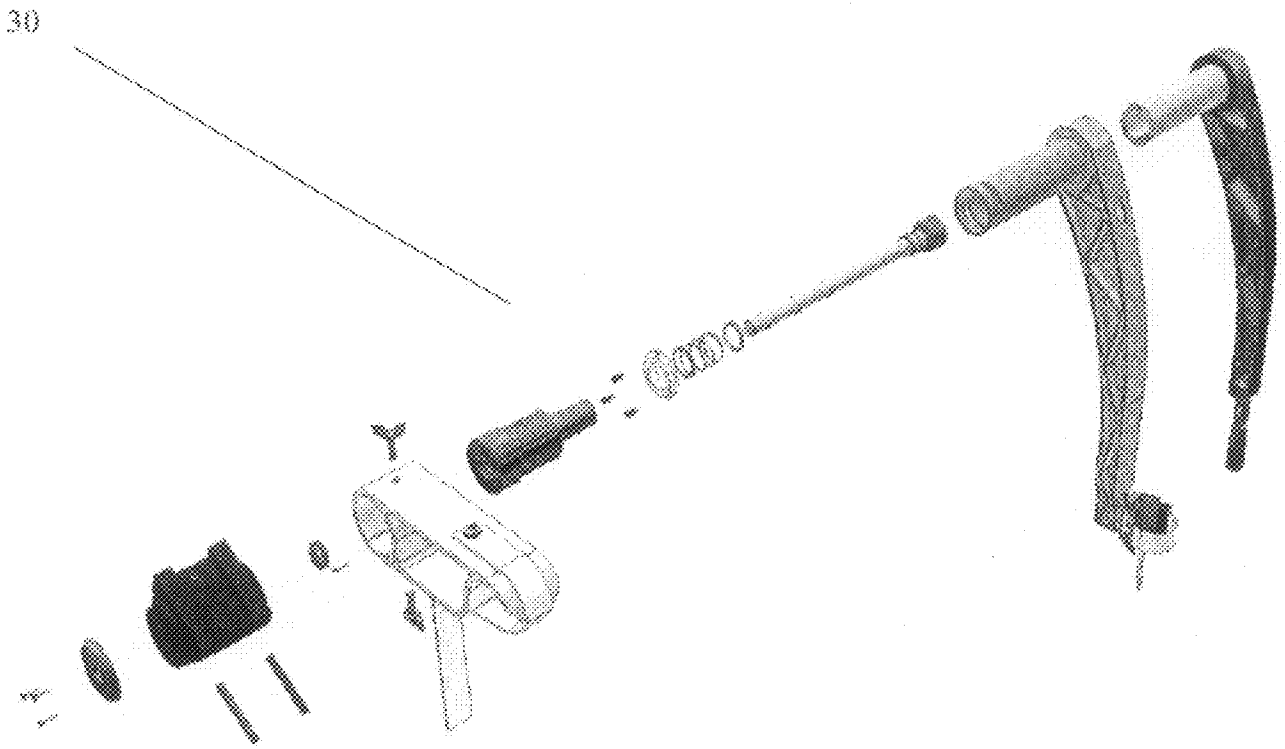
FIG. 17A is an exploded view of an entire hanger system, free of attachment to a sports goal.
Figure 18B:
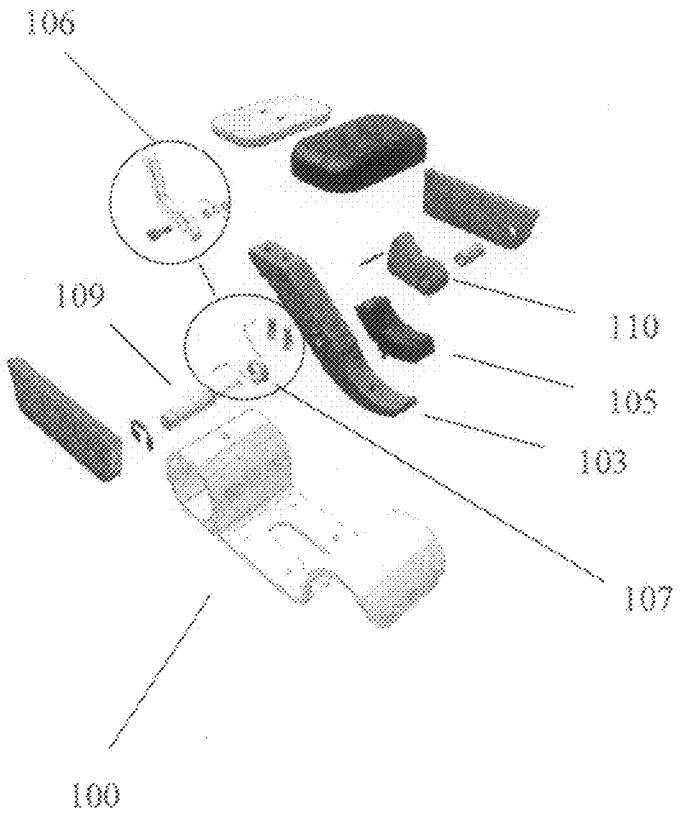
FIG. 18B is an exploded view of an alternate extruded aluminum ratcheting hangar assembly comprising mechanical clamping.
Figure 18A:
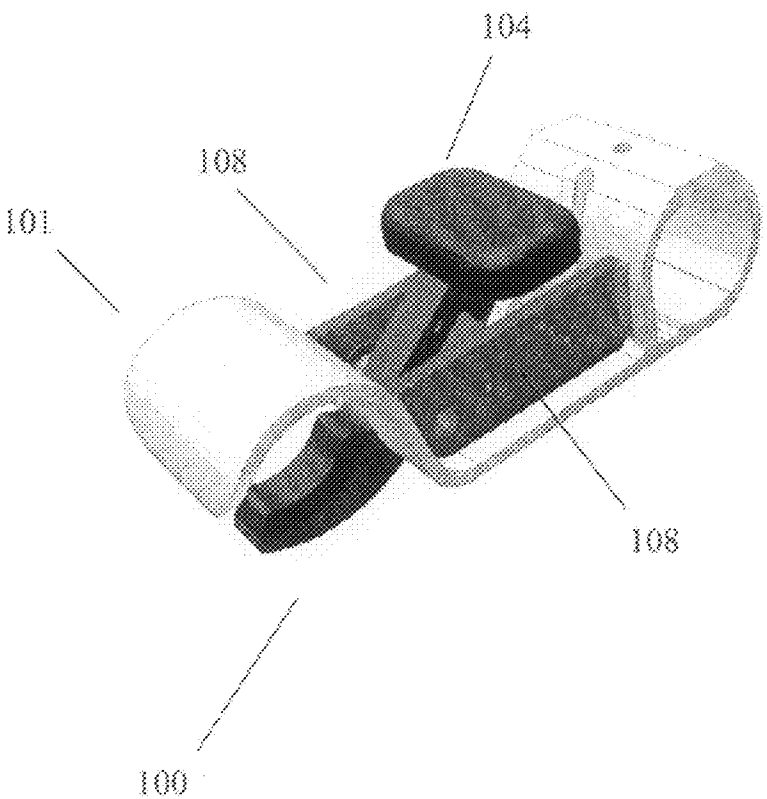
FIG. 18A is an isometric view of an alternate extruded aluminum ratcheting hangar assembly comprising mechanical clamping.

FIG. 17 illustrates is a rear isometric view of the entire system with the backstop net removed and the flexible pultrusion rods retracted and resting again the existing sports goal. FIG. 17A is an assembly drawing of an entire hanger assembly 30, free of attachment to a sports goal. FIG. 18A is an isometric view of an alternate embodiment of extruded aluminum ratcheting hanger assembly comprising a mechanical clamping system which can be removed quickly and easily. FIG. 18B is an exploded view of an alternate extruded aluminum hanger mechanism comprising mechanical clamping. FIG. 18B illustrates that the alternate extruded aluminum ratcheting hanger mechanism 100 may exist as a clamping system 100 comprising: a base member 101, a clamping mechanism 102 comprising: a lever arm 103, a pushpad 104 and a contact pad 105.

The clamping system further comprises a tensioning assembly 106 in communication with the clamping mechanism and the tensioning assembly may comprise a spring member 107 in communication with the base member 101 and the lever arm 103, a pair of opposed system braces 108 in communication with the base member 101, a shaft member 109 disposed between the pair of opposed system braces 108 and in communication with the lever arm 103 and said spring member 107; a locking mechanism 110.

In operation, depression of the pushpad lowers the lever arm against the spring and raises the contact pad against a member to be clamped, developing a tension component upon said member to be clamped and wherein said locking mechanism maintains tension upon, said member to be clamped. The clamping mechanism illustrated here may also be utilized for further applications in addition to the securing the sports goal practice backstop shown herein.

Figure 19B:
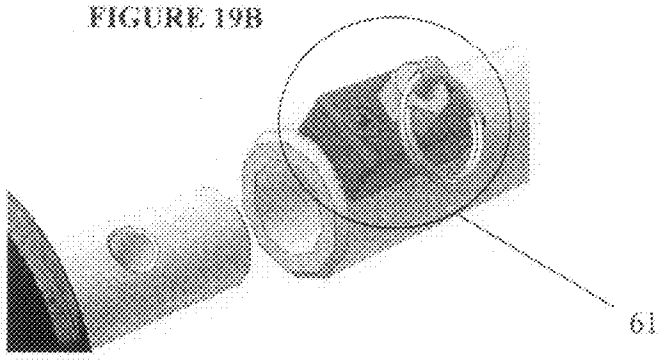
FIG. 19B is an isometric exploded view of an individual of one embodiment of an intermediary shaft quick release mechanisms.
Figure 20:
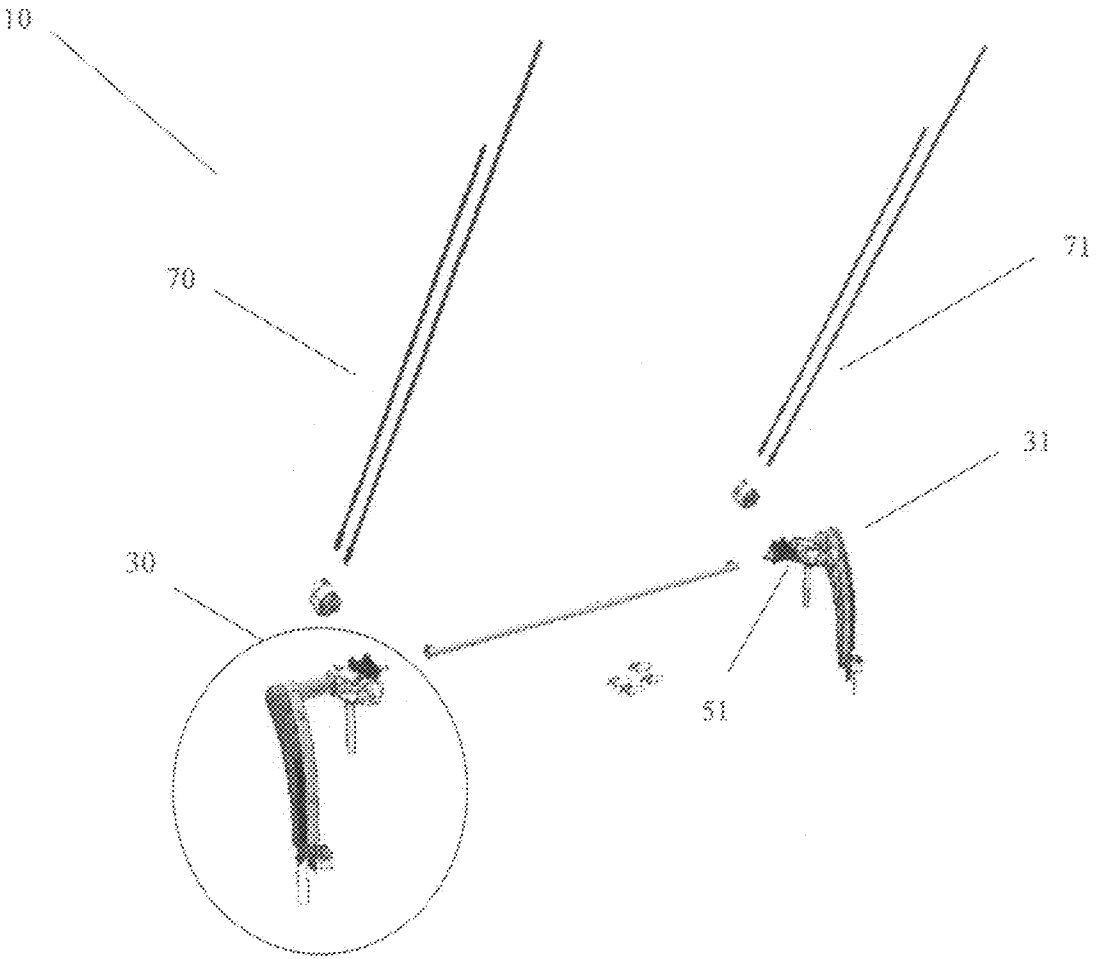
FIG. 20 is an isometric partially exploded view of the entire system not attached to a goal.
Figure 21:
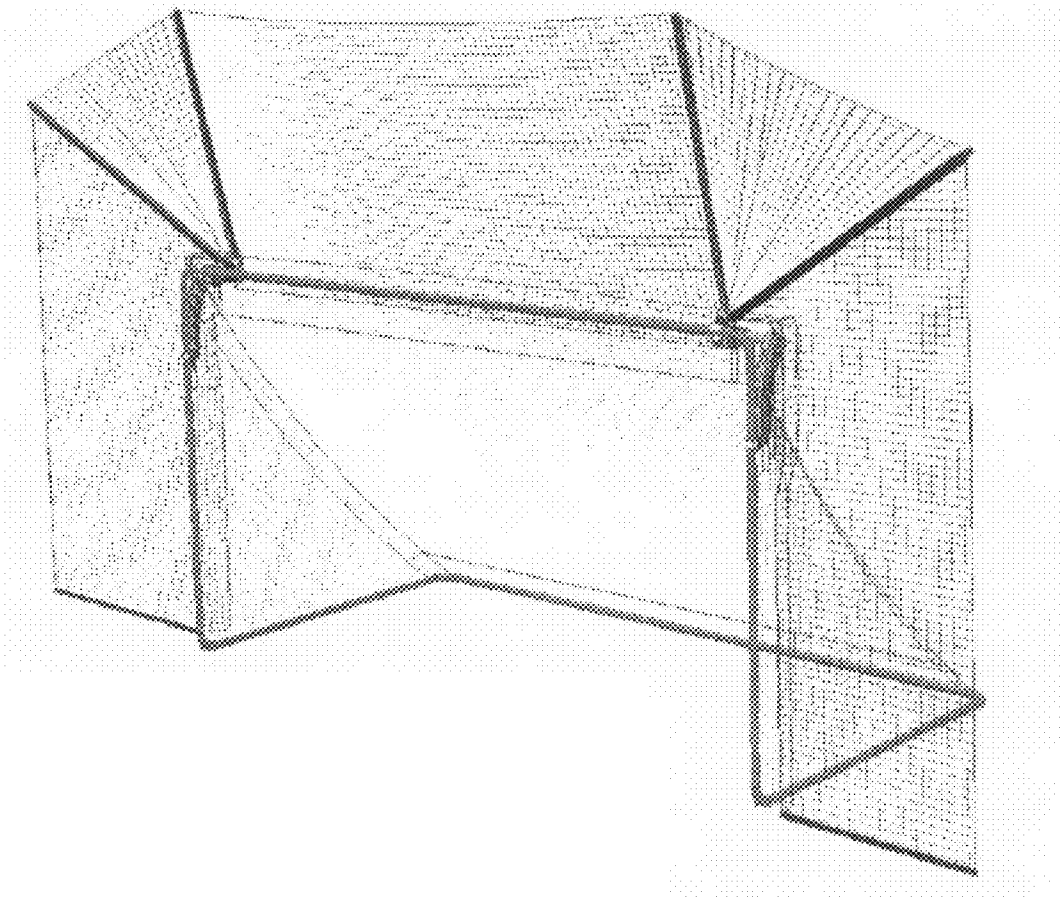
FIG. 21 is an isometric view of the entire system as illustrated attached to a soccer goal.
Figure 22:
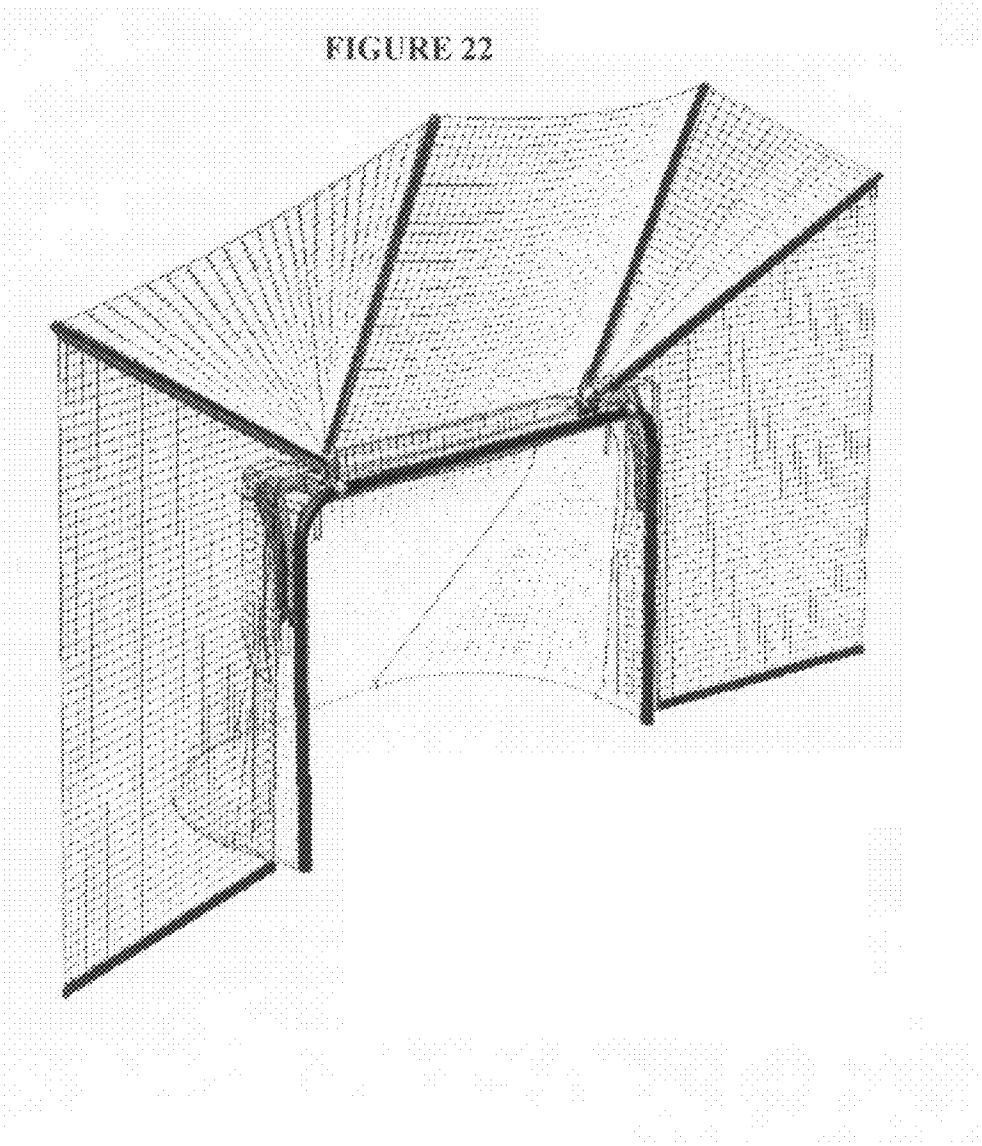
FIG. 22 is an exploded view of the entire system as illustrated attached to a hockey goal.
Figure 23:
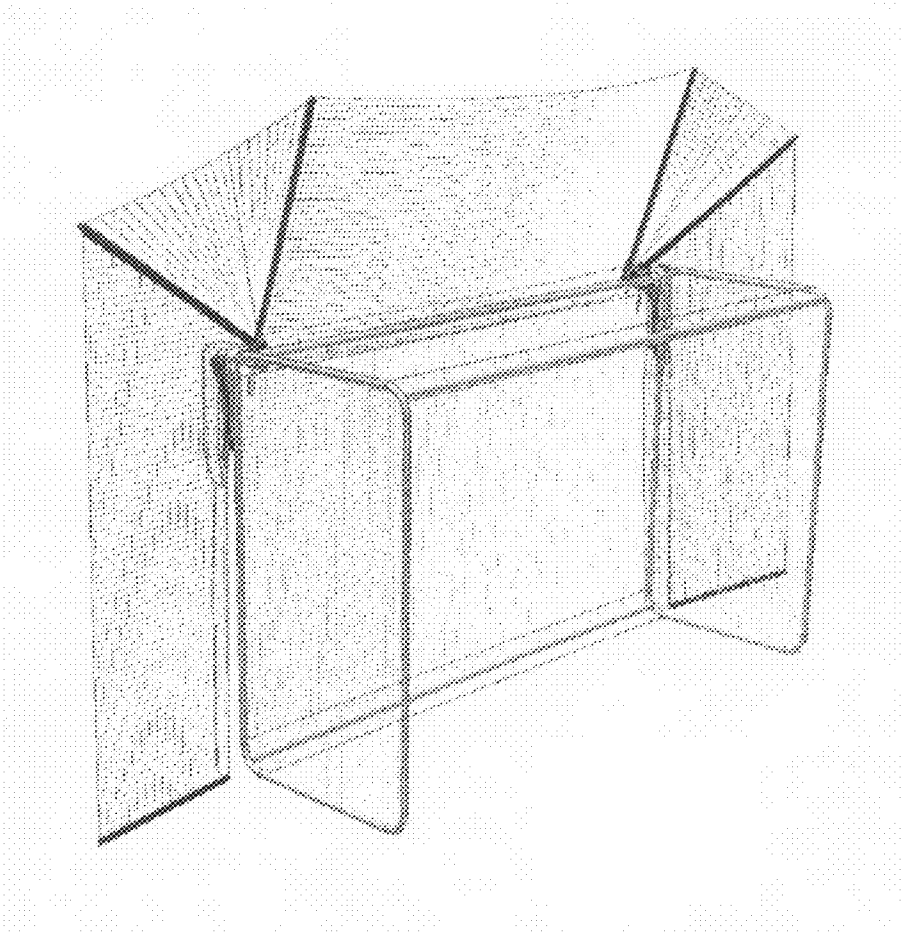
FIG. 23 is an exploded view of the entire system as illustrated attached to a field hockey goal; and, FIG. 24 illustrates the instant apparatus stowed in a tote bag with the netting removed.

FIG. 19A is an isometric view of one embodiment of intermediary shaft quick release mechanisms illustrated within the entire system. FIG. 19B is an isometric view of an individual of one embodiment of an intermediary shaft quick release mechanisms. FIG. 20 is a rear isometric exploded view of the entire system not attached to a net. FIG. 21 is a rear isometric exploded view of the entire system as illustrated attached to a soccer net. FIG. 22 is a rear isometric exploded view of the entire system as illustrated attached to a hockey net. FIG. 23 is a rear isometric exploded view of the entire system as illustrated attached to a field hockey net.

The following instructions illustrate properly assembly, operation, breakdown and stowage of the one embodiment of the system described herein, this being a system without the removable sliding blocks, as follows:

Setup & Installation

Locate the Counter Balance Bladder. Remove the spout caps and fill it with water. Secure the spout caps when filled.

Place the Counter Balance Bladder on the rear of the goal. Positioning it so the unfilled areas match the goal framework.

Lift the rear of the goal slightly to secure the bladder to the goal using the hook and loop fastening straps.

Locate the right and left Support Structure Assemblies and place them on a flat surface behind the net.

Locate the Goal Spacer Tube and install it onto the right and left Support Structure Assemblies at the end shafts.

Pull up the spring-loaded plungers, sliding it over the end shaft, lining up the holes in the shafts and tubes and release the spring-loaded plunger.

Rotate and slide the Center Spacer until the plunger aligns with the holes in the shafts and retracts to secure the Center Spacer and Support Structures.

Loosen the four Thumb Screws (2 per side, one top, one bottom) on the Hangers.

Rotate the Hangers upward approximately 70 degrees (slightly less than vertical) until the Hanger can no longer rotate further.

Tighten the four Thumb Screws (2 per side, one top, one bottom) on the Hangers.

Remove the Cinch Straps from their respective retainers (4 total).

Select the correct diameter Shim that closely matches the diameter of the goal tube that you have by placing them against the goal.

Depending on what diameter tube you have on your goal, snap the Hanger Diameter Shims onto the Hangers in the following order.

a. 1.75" TUBE into either side, making certain that the Shim snaps into place.

b. 1.50" TUBE into the opposite side, making certain that the Shim snaps into place.

With a person at either end of the Backstop System, lift the assembly and place the Hangers onto the top horizontal tube of the goal.

Center and align the Support Structures to the vertical tubes of the goal.

Secure the Hangers by wrapping the Cinch Strap around the goal tube and into their retainers. Pull the Cinch strap tight and secure by rotating the clasp.

Repeat the same for the side Cinch Straps.

Locate the Net in the box and lay it out flat on the ground behind the goal.

Unfold the net behind the goal.

Locate the Slider Blocks (attached to the rods) and install them to the net.

Lift the Net assembly onto the Backstop System, inserting the Slider Blocks into the Pivot Blocks. Slide them full into position until the spring-loaded plunger engages the Slider Blocks.

Operation

Deployment:

Pull the either of the two Handles out, rotating them to the front of the goal while keeping outward tension on the handles. When the handles engage the internal cams, keep outward tension on them to keep the cams engaged.

Rotate the handles down and rearward to deploy the sports backstop.

Flip the side nets outward and allow them to fall to the side of the goal.

Release the handles and push them inward to disengage the cams.

Rotate the handles to align them to the Support Structures using the rubber alignment slugs to help the handles conform to the Support Structures.

Stowage:

Pull either of the two Handles out, rotating them to the rear of the goal while keeping outward tension on the handles. When the handles engage the internal cams, keep outward tension on them to keep the cams engaged.

Flip the side nets inward and allow them to fall to the middle rear of the goal.

Rotate the handles down and forward to stow the sports backstop.

Fold the Pultrusion Rods inward so the arms and Backstop net are within the boundary of the goal.

Release the handles and push them inward to disengage the cams.

Rotate the handles to align them to the Support Structures using the rubber alignment slugs to help the handles conform to the Support Structures.

Therefore, as illustrated herein the sports goal practice backstop of the present invention may be used in conjunction with a multitude typical sports which utilize goals such as soccer, street hockey, ice hockey, field hockey. Further, the backstop may be utilized when practicing sports such as golf.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A sports goal practice backstop for removable attachment to a sports goal comprising:

a removably attachable backstop net mechanism comprises a multiplicity of sections a right and a left support structure, wherein said right and left support structures are removably attached by a right and a left attachment mechanism;

a torsion driven support rod activation system comprising:

a right and left actuation handle assembly in transferred communication with said right and left support structure;

a right and left torque shaft assembly in communication with said right and left actuation handle assembly and in transferred communication with said right and left support structure;

a right and left pivot block assembly comprising independently moving sections, disposable to receive flexible pultrusion rods in communication with said right and left torque shaft assembly and in communication with said right and left actuation handle assembly wherein said right and left pivot block assemblies rotate inward and outward from a rear side of an existing sports goal;

at least one torque shaft spacer in communication with said left and right pivot blocks;

an attachment mechanism for securing said torsion driven support rod activation system to said existing sports goal;

a plurality of flexible pultrusion support rods comprising a multi-positional, retractable construction, in communication with said right and left pivot block assemblies and possessing means for attachment of said removably attachable backstop net thereto; and, wherein said removably attachable backstop net is in communication with said plurality of support rods and wherein actuation of said right and left actuation handles rotates said right and left pivot blocks outward from said existing sports goal and disposes said right and left support rods in an opposing direction in order to tension said removably attachable backstop net; and wherein said sports goal practice backstop for removable attachment to a sports goal is fully retractable to a position which allows for play with said sports goal practice backstop for removable attachment to a sports goal in place.

2. The sports goal practice backstop of claim 1 wherein said left and right pivot blocks are in rotatable communication with said right and left torque shaft assembly and said right and left actuation handle assembly.

3. The sports goal practice backstop of claim 1 wherein said plurality of support rods comprises four dynamic support rods.

4. The sports goal practice backstop of claim 1 wherein said a torsion driven support rod activation system attachment mechanism further comprises a first and second hanger assembly.

5. The sports goal practice backstop of claim 4 wherein said first and second hanger assembly mechanisms further comprise:

a first and second hanger retaining mechanism; and, a first and a second adjustable hanger cinch strap mechanism.

6. The sports goal practice backstop of claim 1 wherein said right and left torque shaft assemblies comprise:
a shaft member;
a retaining member;
a washer member;
a torsion mechanism tensioning member; and,
a fastening mechanism.

7. The sports goal practice backstop of claim 6 wherein said right and left tensioning mechanism member said torsion mechanism further comprises comprise a spring mechanism.

8. The sports goal practice backstop of claim 1 wherein said right and left pivot block assemblies comprise:
a shaft housing apparatus comprising:
a first and a second shaft receiving area disposed to receive said torque shaft assembly and actuation handle assembly; and,
a removably attachable locking pin mechanism;
a support rod retaining housing in communication with said shaft housing apparatus, disposed to receive and maneuver said plurality of support rods upon actuation of said shaft housing apparatus and further comprising an aperture disposed to receive said removably attachable locking pin mechanism and in communication with said shaft housing apparatus, further comprising:
a static housing retaining mechanism;
a forward and a rear rotatable support rod receiving hub;
a forward and a rear washer member;
a forward and a rear gasket member,
an aperture disposed to removably receive said locking pin mechanism;
a forward fastening mechanism; and,
an aperture disposed to removably receive said locking pin mechanism, wherein upon rotation of right and left actuation handle, said shaft housing apparatus transfers rotation to said forward and rear rotatable support rod receiving hubs in order to actuate said support rods.

9. The sports goal practice backstop of claim 1 wherein said support rod retaining housing comprises a slider block.

10. The sports goal practice backstop of claim 1 wherein said plurality of support rods comprises two right opposingly moving support rods and two left opposingly moving support rods.

11. A removably attachable retractable goal practice apparatus comprising:
a left hanger assembly comprising:
a left spring loaded actuation lever;
a pair of left net retainer rods;
a left rotating pivot block disposed to retain said plurality of left net retainer pultrusion rods comprising a multi-positional, retractable construction wherein said pivot block extends and retracts said net retainer pultrusion rods comprising a multi-positional, retractable construction relative to said existing sports goal;
a left torque bar assembly;
a left support structure; and,
a left support hanger for attachment to an existing goal;
a right hanger assembly comprising:
a right spring loaded actuation lever;
a plurality of right net retainer rods;
a right rotating pivot block in communication with a torsion driven shaft disposed to retain said plurality of right net retainer pultrusion rods comprising a multi-positional, retractable construction wherein said pivot block extends and retracts said net retainer pultrusion rods comprising a multi-positional, retractable construction relative to said existing sports goal;
a right torque bar assembly;
a right support structure;
a right support hanger for attachment to an existing goal;
a removably attachable net mechanism in communication with said plurality of right and left net retainer rods; and,
at least one intermediate linking torque shaft mechanism in communication with said right and left hanger assemblies wherein application of a rotational force upon said right and left spring loaded actuation lever tensions said intermediate torque shaft mechanism, rotates said left and right pivot block, extends said plurality of left and right net retainer rods and tensions said removably attachable net mechanism; and
wherein said removably attachable retractable goal practice apparatus is completely retractable to a position which allows for regulation play with said removably attachable retractable goal practice apparatus in place.

12. The removably attachable retractable goal practice apparatus of claim 10 wherein said at least one intermediate torque shaft mechanism comprises two torque shaft mechanisms.

13. A sports goal practice backstop for attachment to an existing sports goal comprising:
a removably attachable backstop net comprising:
at least one left section;
at least one middle section; and,
at least one right section;
a left and right support structure assembly;
a goal spacer tube comprising a first end attached to an end of said right support structure assembly and a second end attached to said left support structure assembly;
a plurality of hanger assemblies comprising rotatable hanger members;
a plurality of hanger shims;
a primary cinch strap in communication with said hanger assemblies;
a plurality of side cinch straps disposed to be threaded through a cradle mechanism;
a set of two outer net tubes threaded over a set of longer flexible pultrusion;
a set of two inner net tubes threaded over a set of shorter flexible pultrusion;
a set of rotation pucks comprising a series of holes and a plurality of net retention straps secured over said holes;
a counter balance bladder disposed to contain fluid comprising:
a set of fluid receiving spouts; and,
a set of removably attachable spouts caps, wherein said spout caps are removed during fluid filling and reaffixed upon completion of fluid filling and wherein the counter balance bladder disposed to attach to the rear of said goal such that a set of unfilled areas match said goal framework; wherein the counter balance bladder is disposed to be place in a lower, rear portion of said existing sports goal in order to counter balance a quantity of weight added to the front portion of said existing sports goal upon attachment of said sports goal practice backstop
wherein said right support structure assembly is disposed with an end shaft, said left support structure assembly is disposed with an end shaft and a goal spacer tube wherein said goal spacer tube is attached to said right and left support structure assemblies at said end shafts and thus align a set of transverse holes located in said shafts and tubes;
wherein said assembly is lifted and said hangers are placed onto the top horizontal tube of an existing goal assembly and wherein said support structures are centered and aligned to the vertical tubes of the goal; and said hangers are secured by wrapping said primary cinch strap around said goal tube and back into a retainer and wherein said side cinch straps are threaded through said cradles; and, wherein for attachment of said backstop net, said backstop net is laid out flat behind the goal, said two outer net tubes are threaded over said longer flexible pultrusion rods, said two inner net tubes are threaded over said shorter flexible pultrusion rods; and wherein said sports goal practice backstop is fully retractable to a position which allows for play with said sports goal practice backstop in place.

* * * * *